US011759914B2

(12) United States Patent
Thielges et al.

(10) Patent No.: US 11,759,914 B2
(45) Date of Patent: Sep. 19, 2023

(54) VISE ASSEMBLY

(71) Applicant: Mate Precision Technologies Inc., Anoka, MN (US)

(72) Inventors: Bruce Thielges, Fridley, MN (US); Patrick Bear, Richfield, MN (US); William Dahlquist, Cambridge, MN (US); Gregory Ferry, Milaca, MN (US); Steven Flynn, Elk River, MN (US); Joseph Schneider, Elk River, MN (US); Larry Villeneuve, Zimmermann, MN (US); Christopher Wark, Zimmermann, MN (US)

(73) Assignee: Mate Precision Technologies Inc., Anoka, MN (US)

( * ) Notice: Subject to any disclaimer, the term of this patent is extended or adjusted under 35 U.S.C. 154(b) by 42 days.

(21) Appl. No.: 17/396,433

(22) Filed: Aug. 6, 2021

(65) Prior Publication Data

US 2022/0040819 A1 Feb. 10, 2022

Related U.S. Application Data

(60) Provisional application No. 63/061,990, filed on Aug. 6, 2020.

(51) Int. Cl.
*B25B 1/10* (2006.01)
*B25B 1/24* (2006.01)

(52) U.S. Cl.
CPC ..... *B25B 1/103* (2013.01); *B25B 1/2452* (2013.01)

(58) Field of Classification Search
CPC .... B25B 1/00; B25B 1/02; B25B 1/04; B25B 1/10; B25B 1/103; B25B 1/2452; B25B 1/2457
(Continued)

(56) References Cited

U.S. PATENT DOCUMENTS 3,948,728 A 4/1976 Roeschlau et al.
4,008,127 A 2/1977 Gruber et al.
(Continued)

FOREIGN PATENT DOCUMENTS

DE 102015220810 3/2017
EP 0238734 9/1987
(Continued)

OTHER PUBLICATIONS

EP2105257 PE2E Translation; Attachment Clamping Jaws, Sep. 2009; p. 1-4 (Year: 2009).*
(Continued)

*Primary Examiner* — Lee D Wilson
*Assistant Examiner* — Sidney D Hohl
(74) *Attorney, Agent, or Firm* — Dicke, Billig & Czaja, PLLC

(57) ABSTRACT

A vise assembly is disclosed. In one example, the vise assembly includes a vise body and a jaw pusher movably coupled to the vise body. The jaw pusher includes a jaw insert having a first top edge and a second top edge, where the first top edge is an outward extending radius edge. A jaw is provided having a jaw top and a jaw bottom, the jaw bottom including a recess for receiving the jaw insert, the recess including a ramped surface extending longitudinally along a top edge for receiving the jaw insert radius edge and wherein the positioned on the jaw pusher without the use of tools.

20 Claims, 14 Drawing Sheets

(58) Field of Classification Search
USPC ..... 269/43, 45, 156, 271, 253, 254 R, 256
See application file for complete search history.

(56) References Cited

U.S. PATENT DOCUMENTS 4,144,129 A 3/1979 Gruber et al.
4,164,448 A 8/1979 Roeschlau et al.
4,168,205 A 9/1979 Danninger et al.
4,181,575 A 1/1980 Gruber et al.
4,212,938 A 7/1980 Gruber et al.
4,366,249 A 12/1982 Thum et al.
4,399,218 A 8/1983 Gauhl et al.
4,405,445 A 9/1983 Kovach et al.
4,406,445 A 9/1983 Seidel
4,409,328 A 10/1983 Ziegenhorn
4,511,127 A 4/1985 Schron et al.
4,553,847 A 11/1985 Lang
4,721,293 A 1/1988 Schron et al.
RE32,704 E 6/1988 Schron et al.
4,863,205 A 9/1989 Schron et al.
5,229,286 A 7/1993 Jarsch et al.
5,236,837 A 8/1993 Beutler et al.
5,308,770 A 5/1994 Jarsch et al.
5,523,224 A 6/1996 Burtscher et al.
5,617,623 A 4/1997 Schron et al.
5,624,811 A 4/1997 Lang et al.
5,634,734 A 6/1997 Schron et al.
5,649,694 A * 7/1997 Buck ..... B25B 1/2473 269/154
5,679,571 A 10/1997 Burtscher et al.
5,720,476 A 2/1998 Swann et al.
5,743,576 A 4/1998 Schron et al.
5,893,551 A * 4/1999 Cousins ..... B25B 1/103 269/154
D409,895 S 5/1999 Schron et al.
5,921,534 A 7/1999 Swann et al.
5,964,458 A 10/1999 Cutsforth et al.
6,046,073 A 4/2000 Lang et al.
6,068,310 A 5/2000 Fuller et al.
6,109,602 A 8/2000 Schron et al.
6,126,159 A 10/2000 Dornfeld
6,139,001 A * 10/2000 Buck ..... B25B 1/2405 267/43
6,161,994 A 12/2000 Lang
6,241,231 B1 6/2001 Schron et al.
6,273,686 B1 8/2001 Kroell et al.
6,308,943 B1 10/2001 Fischer et al.
6,386,248 B2 5/2002 Johnston et al.
6,390,158 B2 5/2002 Johnston
6,435,496 B1 8/2002 Philips
6,443,514 B1 9/2002 Fuller et al.
6,474,914 B1 11/2002 Lang
6,530,567 B1 3/2003 Lang
6,551,220 B1 4/2003 Schroeder
6,631,543 B2 10/2003 Retzbach
6,652,012 B1 11/2003 Fuller et al.
6,702,721 B2 3/2004 Schroeder
6,719,281 B2 4/2004 Kohlert
6,736,383 B2 5/2004 Kohlert
6,783,310 B2 8/2004 Kohlert et al.
6,799,757 B1 10/2004 Lang
6,832,755 B2 12/2004 Kohlert
6,905,116 B2 6/2005 Cummines
6,929,275 B1 8/2005 Schlangen
6,945,916 B2 9/2005 Schroeder
D526,068 S 8/2006 Schlangen et al.
7,087,854 B2 8/2006 Takahashi et al.
7,090,030 B2 8/2006 Miller
D533,436 S 12/2006 Stapulionis et al.
D534,777 S 1/2007 Miller
7,163,201 B2 1/2007 Bernstein
7,210,541 B2 5/2007 Miller
7,354,350 B2 4/2008 Hechtle et al.
7,399,231 B2 7/2008 Glimpel et al.
7,419,339 B2 9/2008 Glimpel et al.
7,467,577 B2 12/2008 Glimpel et al.
D596,921 S 7/2009 Hageman et al.
7,625,292 B2 12/2009 Glimpel et al.
7,665,717 B2 2/2010 Lenzini
7,708,854 B2 5/2010 Kroeninger et al.
7,731,465 B2 6/2010 Stapulionis et al.
7,828,077 B1 11/2010 Miller et al.
7,891,903 B2 2/2011 Klingenberg et al.
7,914,225 B2 3/2011 Hageman
7,927,221 B2 4/2011 Glimpel et al.
D640,521 S 6/2011 Tschida et al.
7,998,032 B2 8/2011 Schroeder
8,020,877 B2 9/2011 Lang
8,109,494 B1 2/2012 Warth
8,162,581 B2 4/2012 Soltis et al.
8,167,291 B2 5/2012 Parks et al.
D666,072 S 8/2012 Tschida et al.
8,272,817 B2 9/2012 Glimpel et al.
8,307,849 B2 11/2012 Fuller
8,336,867 B1 12/2012 Warth
D678,925 S 3/2013 Glimpel et al.
8,408,527 B2 4/2013 Klingenberg et al.
8,454,004 B1 6/2013 Warth
D686,647 S 7/2013 Glimpel et al.
8,534,658 B2 9/2013 Schron et al.
8,573,578 B1 11/2013 Warth
8,672,310 B2 3/2014 O'rell et al.
8,708,323 B2 4/2014 Hoyt et al.
8,720,874 B2 5/2014 Tschida et al.
8,727,329 B2 5/2014 Schron et al.
8,757,693 B2 6/2014 Fuller et al.
8,777,530 B2 7/2014 Leibald
8,858,134 B2 10/2014 Glimpel et al.
8,905,392 B1 12/2014 Warth
8,920,063 B1 12/2014 Easley
8,992,143 B2 3/2015 Glimpel et al.
9,004,472 B2 4/2015 Schmidt
9,004,476 B2 4/2015 Schmidt
9,033,624 B2 5/2015 Glimpel et al.
9,067,766 B1 6/2015 Bateman
9,095,958 B2 8/2015 Schmidt
9,126,299 B2 9/2015 O'rell et al.
9,133,867 B2 9/2015 Lang
9,193,040 B2 11/2015 Schmidt
9,216,484 B2 12/2015 Bishop et al.
9,227,303 B1 1/2016 Warth
9,259,633 B2 2/2016 Meyers
9,302,889 B2 4/2016 Bateman et al.
9,352,451 B1 5/2016 Warth et al.
9,364,937 B2 6/2016 Taylor et al.
9,381,621 B2 7/2016 Taylor et al.
D775,058 S 12/2016 Overman et al.
9,570,724 B2 2/2017 Lang
9,610,474 B1 4/2017 Carlsen
9,630,267 B2 4/2017 Glimpel et al.
9,656,719 B1 5/2017 Meyers
9,662,728 B2 5/2017 Glimpel et al.
9,705,113 B2 7/2017 Lang
9,724,773 B2 8/2017 Glimpel
9,814,931 B1 11/2017 Carlsen
9,902,033 B1 2/2018 Taylor et al.
D815,507 S 4/2018 Mardaus
10,040,173 B1 8/2018 Warth
10,179,392 B2 1/2019 Taylor et al.
10,384,331 B2 8/2019 Maggert
10,450,174 B1 10/2019 Kucinic et al.
10,603,750 B1 3/2020 Taylor et al.
2003/0111786 A1 6/2003 Fries
2004/0256780 A1 12/2004 Lang
2010/0219573 A1 9/2010 O'rell et al.
2014/0001692 A1 1/2014 Schmidt
2014/0197587 A1 7/2014 O'rell et al.
2015/0020372 A1 1/2015 Linder et al.
2017/0165801 A1 6/2017 Chuang
2017/0368651 A1 12/2017 Lang
2018/0099383 A1 4/2018 Maggert
2019/0389036 A1* 12/2019 Taylor ..... B25B 1/2452

(56) References Cited

U.S. PATENT DOCUMENTS

| | | | | |
|---|---|---|---|---|
| 2020/0070291 | A1 | 3/2020 | Chou | |
| 2020/0189051 | A1 | 6/2020 | Taylor et al. | |
| 2021/0107117 | A1* | 4/2021 | Hsu | B25B 1/103 |

FOREIGN PATENT DOCUMENTS

| | | | | |
|---|---|---|---|---|
| EP | 2105257 | A2 * | 9/2009 | B25B 1/103 |
| JP | 2017164846 | | 9/2017 | |

OTHER PUBLICATIONS

"Vise Jaws Grip Small Surfaces", Dec. 16, 2013, https://www.aerospacemanufacturinganddesign.com/article/amd1213-sintergrip-vise-jaws.

International Search Report and Written Opinion in PCT/US21/45080 dated Jan. 18, 2022.

* cited by examiner

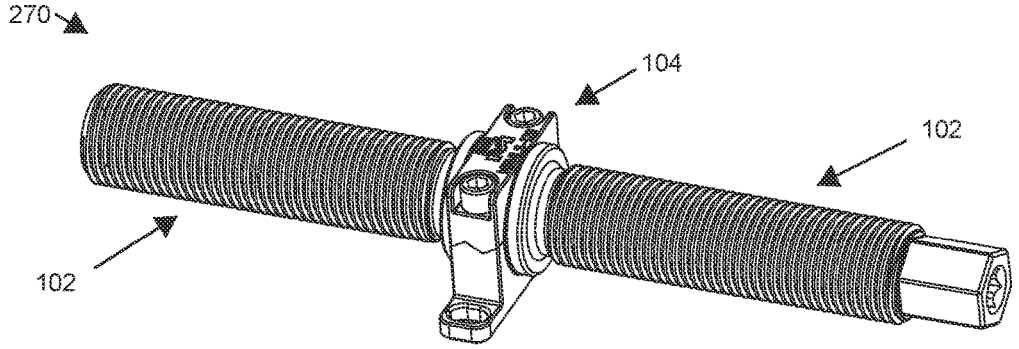
Fig. 11
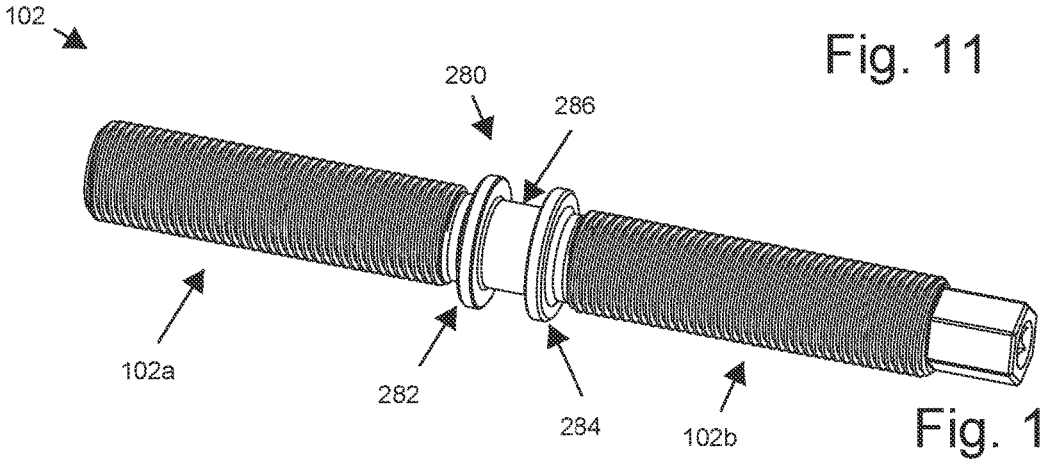
Fig. 12
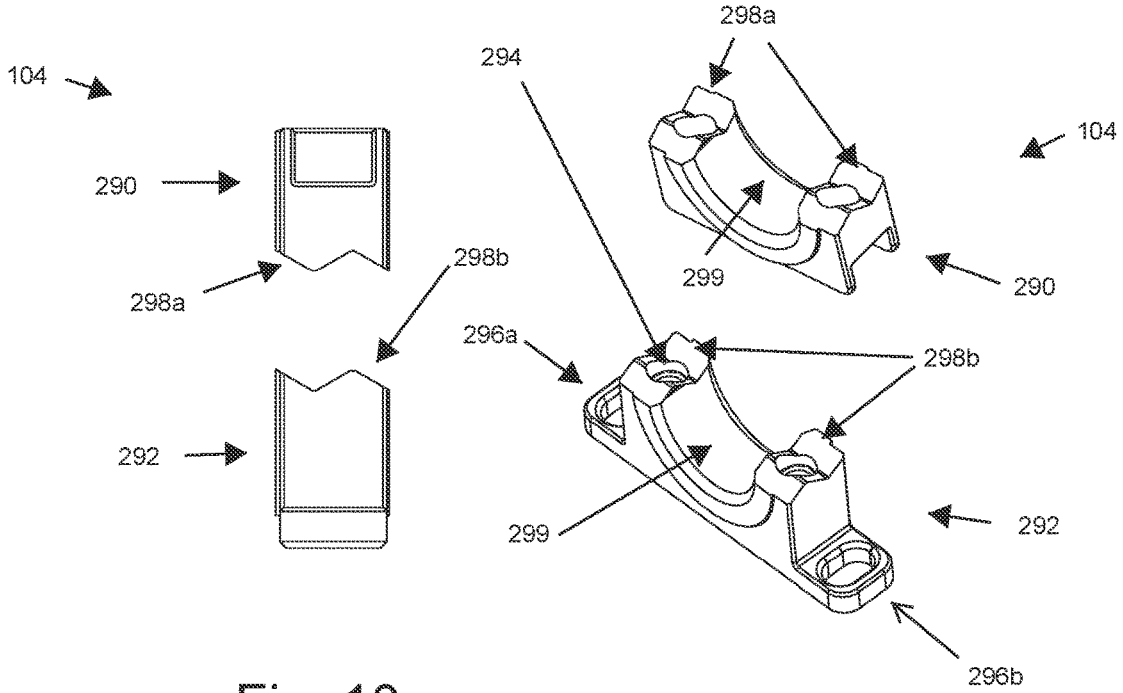
Fig. 13
Fig. 14

VISE ASSEMBLY

CROSS-REFERENCE TO RELATED APPLICATION

This application is a non-provisional of U.S. Patent Application Ser. No. 63/061,990, filed Aug. 6, 2020, which is incorporated herein by reference.

BACKGROUND

Known vise assemblies are positioned within a base and are used to hold a piece part for machining. The vise assembly provides for one or more piece parts to be securely held while maintaining accurate registration for machining.

For these and other reasons, a need exists for the present invention.

SUMMARY

One or more examples include a vise assembly for securely and accurately holding a piece-part or multiple piece-parts for machining. In one example, the vise assembly includes a vise body, and lead screw. A center support attaches and supports the lead screw on the body. A pusher converts torque from the lead screw to force applied to the vise jaws and piece-part. Quick change jaws are operably coupled to the vise body. The jaws contact and hold the piece-part, are reversible, and no tools are required to position the jaws on the vise body. Jaw pushers are reversible to allow inward and outward clamping. A radiused nosed jaw pusher generates constant contact with internal jaw ramps to produce correct axial force to downward force ratio to effectively clamp parts while reducing jaw lift. In some instances, pull studs extend from the vise body for engagement with a base assembly.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

FIGS. 1-36 illustrate one or more examples of a unique vise assembly for securing and accurately positioning one or more piece-parts for machining.

FIG. 1 illustrates one example of a vise assembly in perspective view.

FIG. 2 illustrates one example of the vise assembly 100 in exploded view.

FIG. 3 illustrates another example of a vise assembly in perspective view.

FIG. 4 illustrates one example of the vise assembly of FIG. 3 in exploded view.

FIG. 5 is a perspective view illustrating one example of jaw for use with a vise assembly.

FIG. 6 is a cross-sectional view of the jaw illustrated in FIG. 5.

FIG. 7 is a side view illustrating one example of a jaw pusher.

FIGS. 8-10 are cross-sectional views illustrating one example of positioning a jaw on a jaw pusher.

FIG. 11 is a perspective view illustrating one example of lead screw with a center support.

FIG. 12 is a perspective view illustrating one example of a lead screw.

FIG. 13 is a side view illustrating one example of a center support for a lead screw having a two part assembly.

FIG. 14 are perspective views illustrating the two part assembly of the center support of FIG. 13.

FIG. 15 is a top perspective view illustrating one example of a vise body.

FIG. 16 is a side view illustrating one example of the vise body of FIG. 15.

FIG. 17 is a side cross-sectional view of the vise body of FIG. 15.

FIG. 18 is a side view illustrating one example of a pusher positioned within a vise body.

FIGS. 19-21 illustrate one example of the starting of pushers on a vise assembly.

FIGS. 22-26 illustrate one example of jaw teeth.

FIGS. 27-30 illustrate one example of a vise assembly with a custom machinable jaw.

FIG. 31 illustrates one example of a dual pusher.

FIG. 32 illustrates one example of a jaw pusher having one or more magnets.

FIG. 33 is a cross-section view illustrating one example of a vise assembly including a jaw pusher having one or more magnets.

FIG. 34 is a perspective view illustrating a vise assembly with a hardened jaw and a custom machinable jaw attached.

FIG. 35 is one example of a vise assembly having a center jaw with float feature.

FIG. 36 is a partial close-up view of the center jaw of FIG. 35.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

FIGS. 1-36 illustrate one or more examples of a unique vise assembly for securing and accurately positioning a piece-part or multiple piece-parts for machining.

Figure 34:
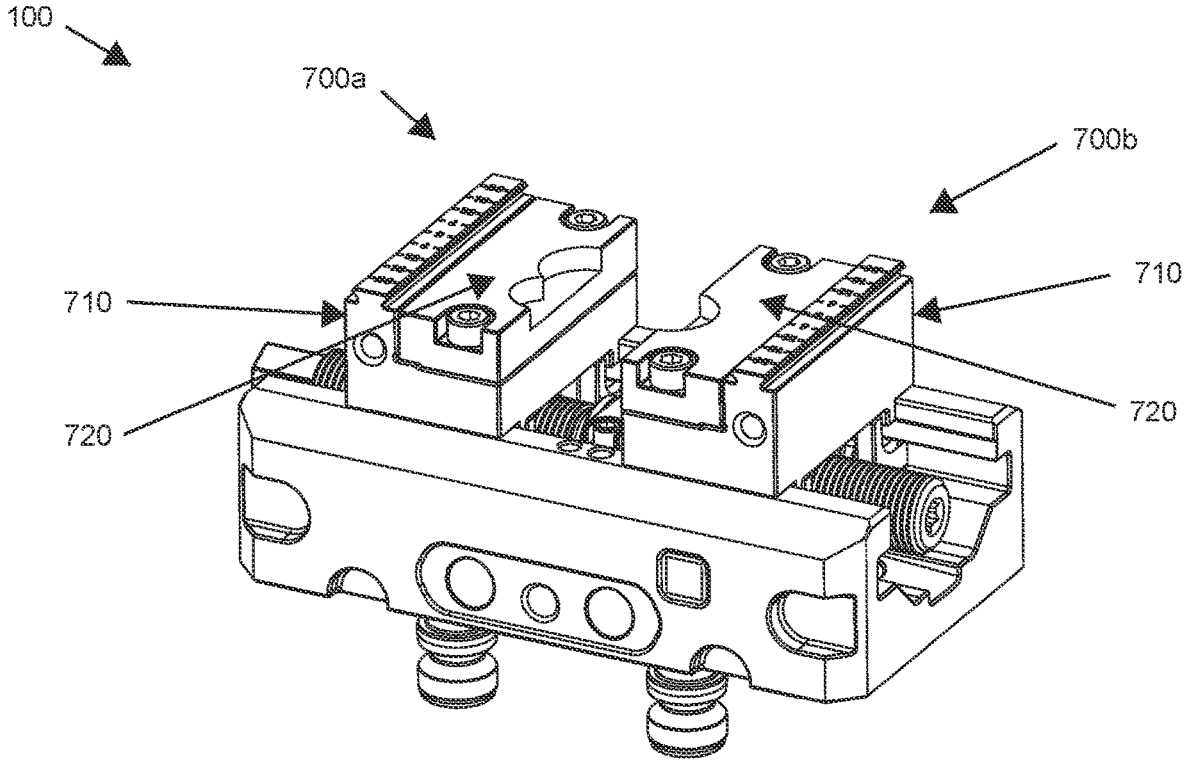

One or more examples include a vise assembly for securely and accurately holding a piece-part for machining. In one example, the vise assembly includes a vise body and lead screw. A center support attaches and supports the lead screw on the vise body. A pusher converts torque from the lead screw to force applied to the vise jaws and piece-part. Quick change jaws are operably coupled to the vise body. The jaws contact and hold the piece-part or piece-parts, are reversible, and no tools are required to position the jaws onto the pushers and on the vise body. The jaw pushers are reversible to produce either inward or outward piece part clamping. The jaws and jaw pushers connections is such that both inward or outward force is generated at the same time downward force is generated to reduce unwanted jaw lifting. Pull studs extend from the bottom of vise body for engagement with a base assembly (as shown in FIG. 34).

Figure 1:
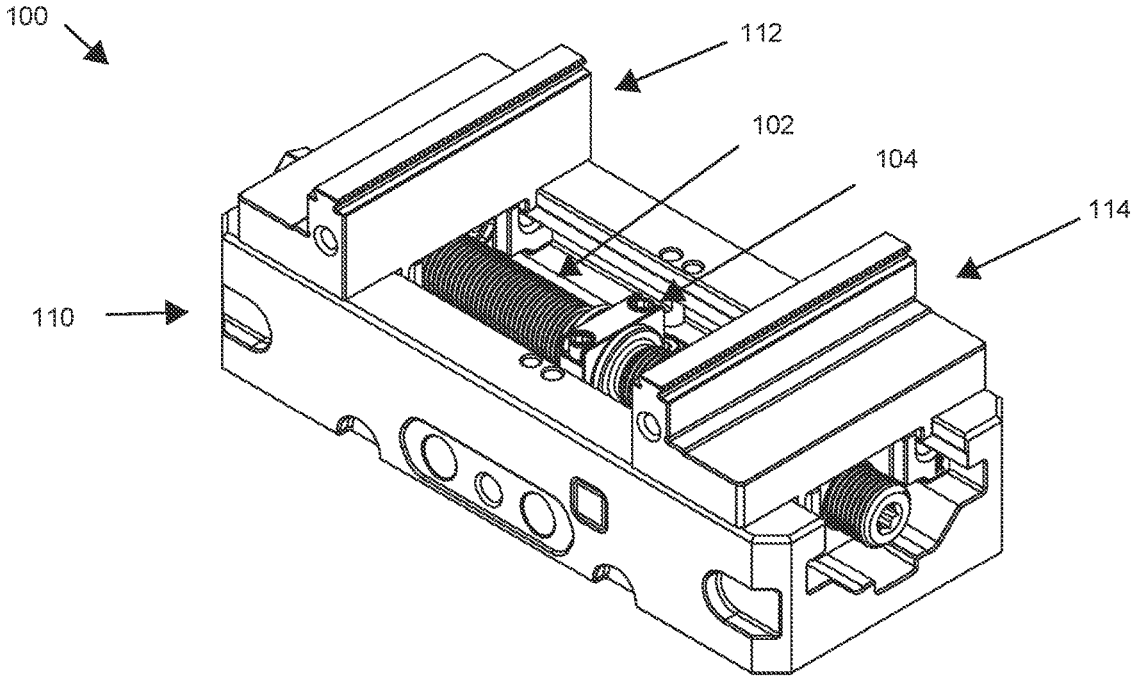

FIG. 1 illustrates one example of a vise assembly in perspective view, shown generally at 100. The vise assembly 100 includes a pair of quick change reversible jaws that allow the jaws to be positioned on the vise assembly without the use of tools. Vise assembly 100 includes a number of additional unique features and elements that will be described in detail in this specification.

Figure 2:
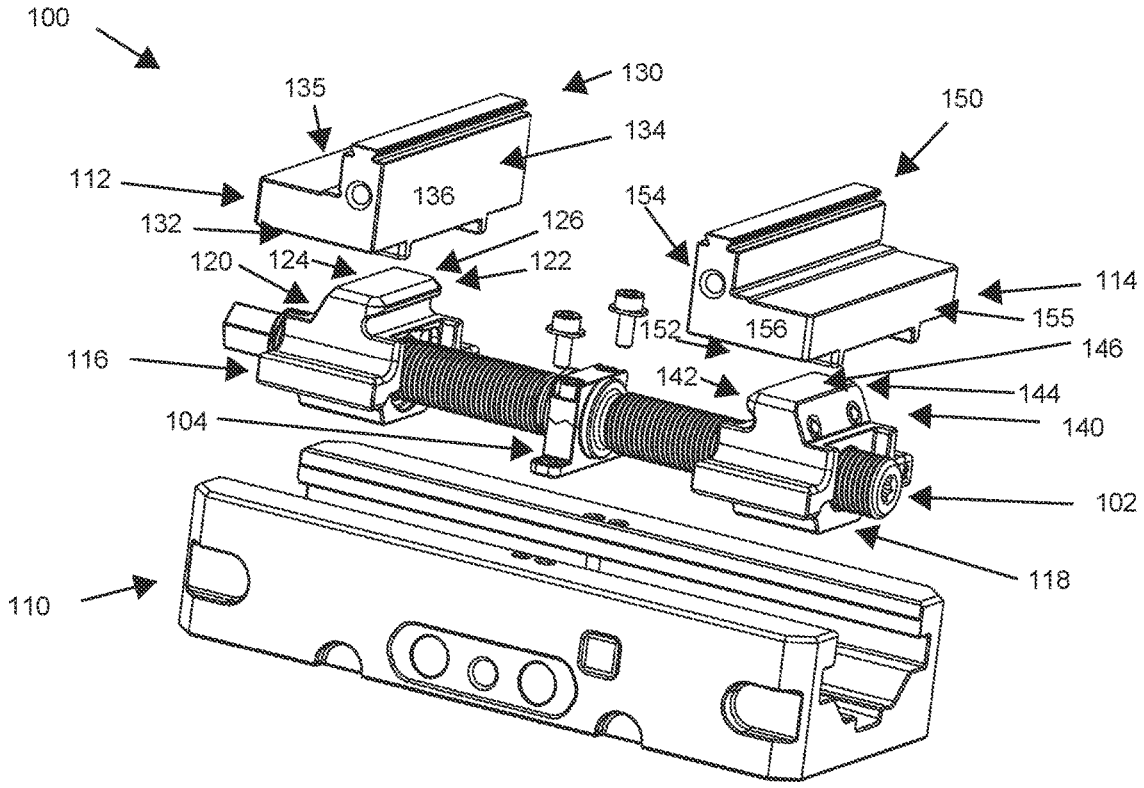

FIG. 2 illustrates one example of the vise assembly 100 in exploded view. Referring to FIG. 1 and FIG. 2, the vise assembly 100 includes a vise body 110, and a first jaw 112 and a second jaw 114 movable relative to the vise body 110. The first jaw 112 and the second jaw 114 are "quick change" jaws. As such, they can be easily positioned on the vise assembly 100 without the use of tools. Additionally, the first jaw 112 and the second jaw 114 are easily reversible on the vise body 110.

The vise assembly 100 includes a lead screw 102 positioned within the vise body 110. A center support 104 attaches and supports the lead screw 102 on the vise body 110.

The vise assembly 100 further includes a pair of jaw pushers, illustrated as first jaw pusher 116 and second jaw pusher 118. During operation of the vise assembly 100, the first jaw pusher 116 and the second jaw pusher 118 are operably positioned on the lead screw 102. The first jaw 112 and the second jaw 114 are movably coupled to the vise body 110 via the pair of jaw pushers. In one aspect, the first jaw 112 is removably coupled to the first jaw pusher 116 and the second jaw 114 is removably coupled to the second jaw pusher 118. The first jaw pusher 116 and the second jaw pusher 118 convert torque from operation of the lead screw 102 to a force that is applied to the first jaw 112 and the second jaw 114, and transferred to a workpiece (not shown) positioned in the vise assembly 100.

The vise assembly 100 including advantageous features of the vise body 110, the first jaw 112, the second jaw 114, the first jaw pusher 116, the second jaw pusher 118, the lead screw 102 and center support 104 is described in further detail in this specification.

In one example, first jaw pusher 116 includes a first jaw insert 120 having a first top edge 122 and a second top edge 124 that extend longitudinally across a top 126 of the first jaw pusher 116. The first top edge 122 is an outward extending radius edge. In one example, the outward extending radius edge has a bull nose design.

The first jaw 112 includes a jaw top 130, and jaw bottom 132, a primary holding surface 134 and a secondary holding surface 135. The jaw bottom 132 includes a first jaw recess 136 (inside of first jaw 112 in FIG. 5) configured to receive the first jaw insert 120. The first jaw recess 136 includes a ramped surface 176 or 178 (FIG. 6) extending longitudinally along a top edge for receiving the first top edge 122 outward extending radius edge. To position the first jaw 112 on the first jaw pusher 116, the first jaw 112 is simply rotated such that first jaw insert 120 is received and positioned within first jaw recess 136 (FIG. 5), all without the use of tools.

Similarly, second jaw pusher 118 includes a second jaw insert 140 having a first top edge 142 and a second top edge 144 that extend longitudinally across a top 146 of the second jaw pusher 116. The first top edge 142 is an outward extending radius edge. In one example, the outward extending radius edge has a bull nose design.

The second jaw 114 includes a jaw top 150, and jaw bottom 152, a primary holding surface 154 and a secondary holding surface 155. The jaw bottom 152 includes a second jaw recess 156 (inside second jaw 114 which is identical to 112 jaw bottom opening 136) configured to receive the second jaw insert 140. The second jaw recess 156 includes a ramped surface (not shown but same as 176 and 178 on 112 jaw in FIG. 6) extending longitudinally along a top edge for receiving the first top edge 142 outward extending radius edge. To position the second jaw 114 on the second jaw pusher 118, the second jaw 114 is simply rotated such that second jaw insert 140 is received and positioned within second jaw recess 156, all without the use of tools.

In one example, jaw top 130 and jaw top 150 each include machined edges to aid in holding a piece part. In one example, the machined edges are serrated edges. The design of jaw top 130 and jaw top 150 is described in detail later in this specification.

Figure 3:
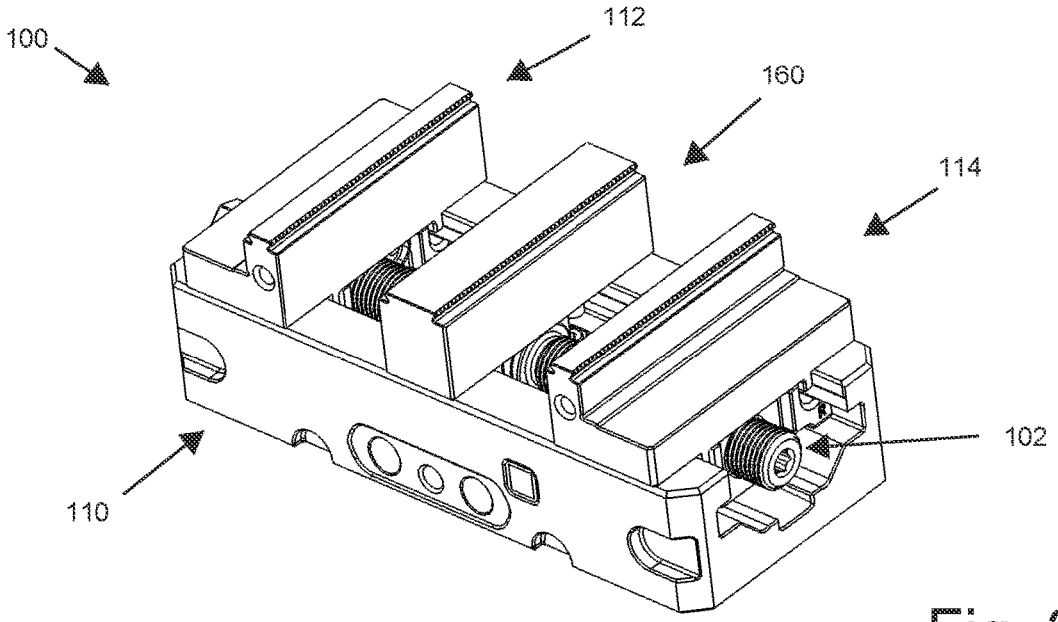
Figure 4:
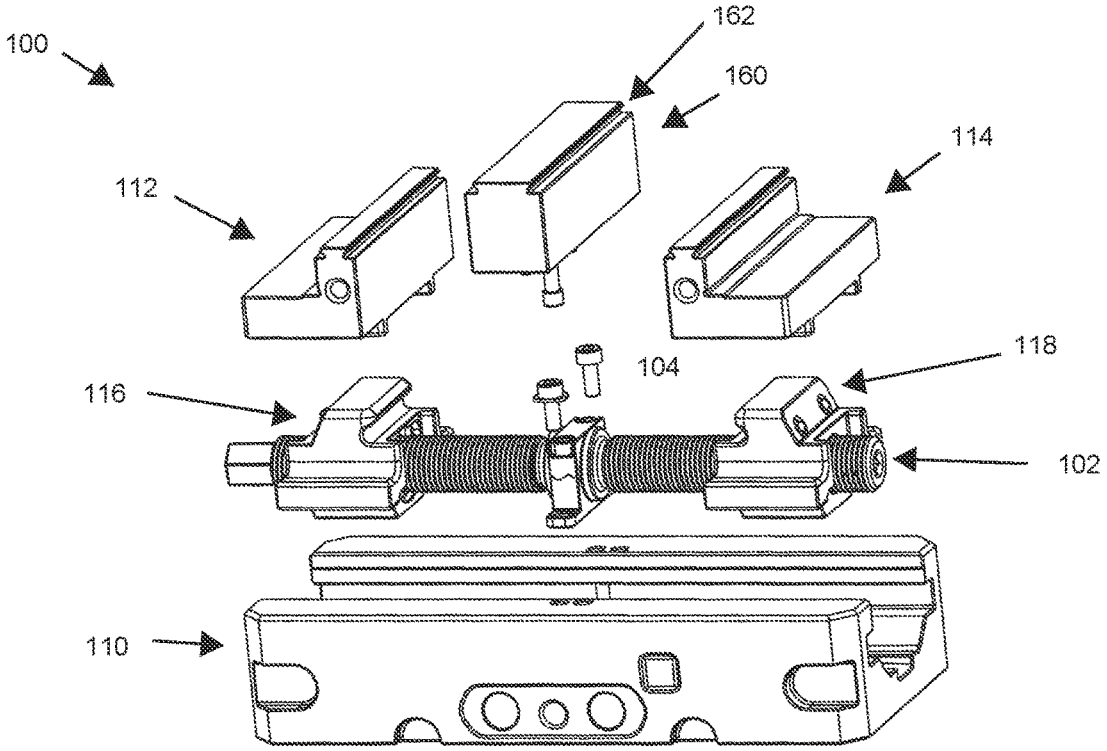

FIG. 3 illustrates another example of a vise assembly in perspective view. FIG. 4 illustrates one example of the vise assembly of FIG. 3 in exploded view. As illustrated in FIG. 3 and FIG. 4, in one example the vise assembly 100 includes a center jaw 160. The center jaw 160 is centered on the vise body 110, including lead screw 102. In one example, the center jaw 160 is positioned over center support 104 and coupled to vise body 110. In operation, the center jaw 160 allows the vise assembly 100 to hold two piece parts. The center jaw 160 may also include a machined top to aid in holding the piece parts, indicated at 162.

Figure 5:
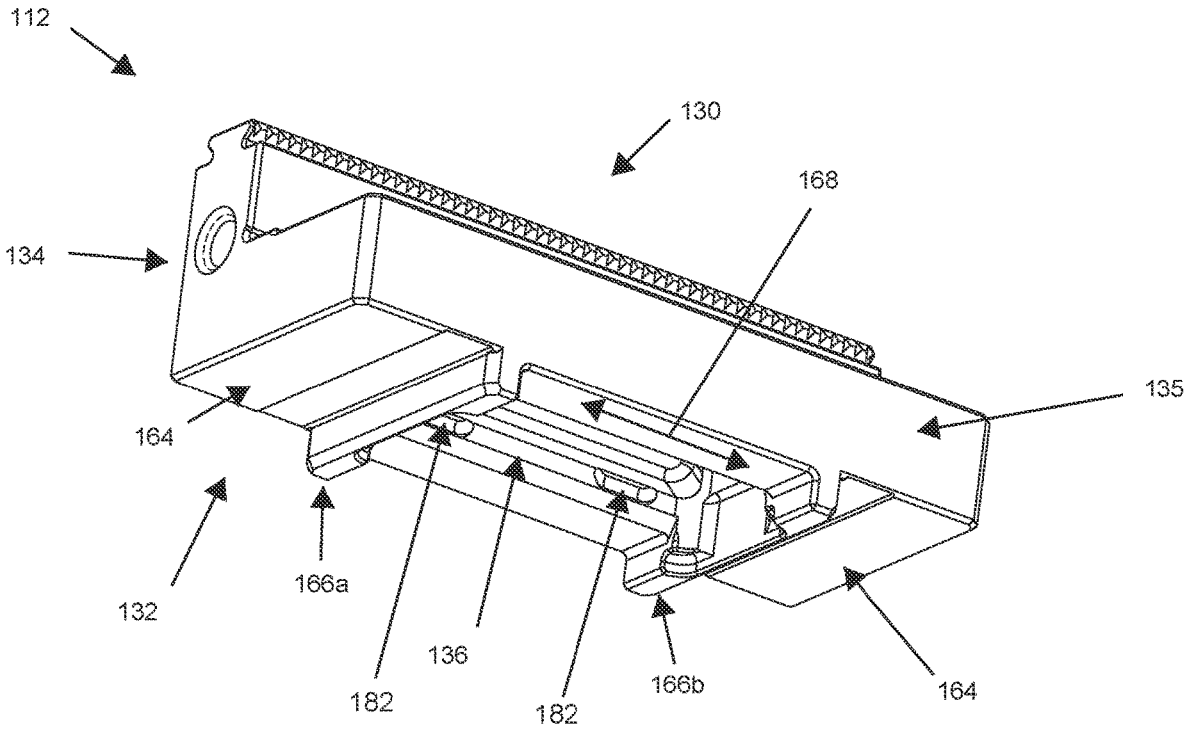

FIG. 5 is a bottom perspective view illustrating one example of a jaw for use with a vise assembly. For ease of description, the vise assembly jaw illustrated in FIG. 5 will be described in reference to first jaw 112. It is noted that first jaw 112 is designed similar to second jaw 114.

As best seen in FIG. 5, first jaw 112 includes a bottom surface 164 and a pair of rails 166*a,b* extending from a bottom surface 164. The bottom surface 164 and rails 166*a,b* contact the vise body 110 and aid in supporting the first jaw 112 as it moves while positioned on the first jaw pusher 116.

Recess 136 extends into first jaw 112 from bottom surface 164. Recess 136 includes an opening 168 in surface 164 that extends longitudinally between rail 166*a* and 166*b*. Recess 136 is sized to receive first jaw insert 120 from first jaw 112. Additionally, the design of recess 136 allows the first jaw 112 to be positioned on the first jaw pusher without the use of tools.

Figure 6:
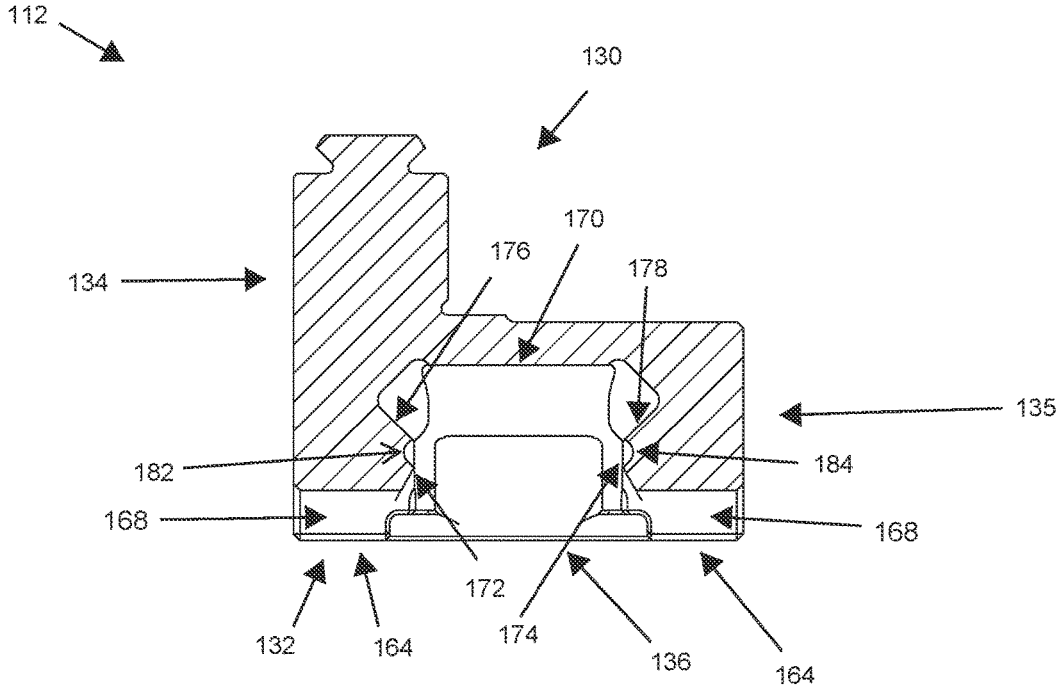

FIG. 6 is a side cross-sectional view of the jaw illustrated in FIG. 5. Recess 136 is advantageously configured/contoured to easily assembly and dis-assemble from the first jaw insert 120 when first jaw 112 is positioned on first jaw pusher 116. In effect, a jaw pusher with jaw insert surfaces effectively contoured along with an effectively contoured jaw receiving pocket allows easy snap-on/snap off installation and removal of the jaw.

In cross-section, the recess 136 includes a generally flat top 170 with a first sidewall 172 and a second sidewall 174 that extend longitudinally within the first jaw 112. The first sidewall 172 includes a first angled surface 176 near the interface of the first sidewall 172 and the top 170. Second sidewall 174 includes a second angled surface 178 near the interface of the second sidewall 174 and the top 170. The first angled surface 176 and the second angled surface 178 extend longitudinally along the top, and aid in receiving and maintaining the first jaw pusher 116 jaw insert 120. In one example, the first angled surface 176 and second angled surface 178 each form a longitudinal slot the extends along top 170. By locating an angled surface on each side of the top 170, the first jaw 112 is reversible and can be positioned on the first jaw pusher 112 in either direction.

The first sidewall 172 includes a first pocket 182 and the second sidewall 174 includes a second pocket 184. In one example, the first pocket 182 is located beneath the first angled surface 176 and the second pocket 184 is located beneath the second angled surface 178. The first pocket 182 and the second pocket 184 are located and aligned on the corresponding sidewalls 172,174 to receive a maintaining mechanism when positioned on a jaw pusher. 182 and 184 represent just one such pocket in FIG. 6, but there can be one or more of these pockets to correspond with the number of maintaining mechanisms. In one example FIG. 5 shows 2 such pockets 182.

Figure 7:
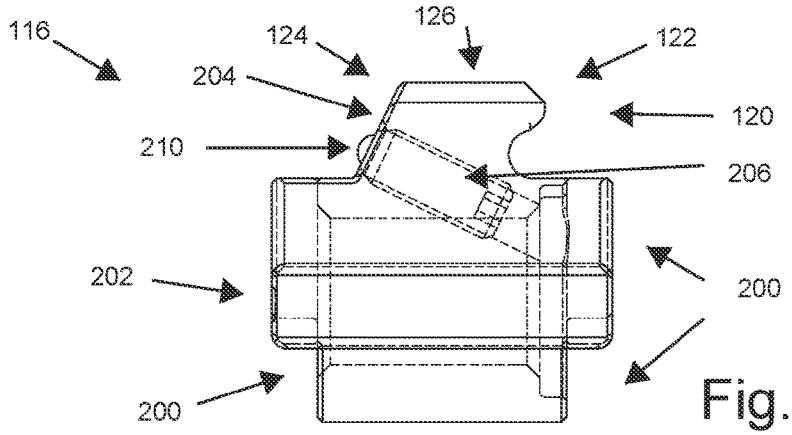

FIG. 7 is a side view illustrating one example of a jaw pusher. For ease of description, the jaw pusher is described with respect to first jaw pusher 116 previously described herein. Jaw pusher 116 includes first jaw insert 120 extending from jaw pusher body 200 that is geometrically and effectively shaped to allow easy assembly with the jaw. The jaw pusher body 200 includes a threaded opening 202 extending therethrough, for receiving a lead screw (e.g., lead screw 102). In one example, the threaded opening 202 has threads that are timed with the threads on the lead screw. The first jaw insert 120 includes first top edge 122 and second top edge 124 that extend longitudinally across a top 126 of the first jaw pusher 116. The first top edge 122 is an outward extending radiused hook. In one example, the outward extending radius edge has a radiused bottom side and a chamfered top side to facilitate easy entry of the jaw recessed pocket. In one example, the second top edge 124 is the start of an angled or slanted sidewall 204 that transitions from the top 126 to the jaw pusher body 200 strategically angled to facilitate easy jaw installation. A retaining member 206 is located within first jaw pusher 116. The retaining member 206 aids in retaining a vise jaw on the first jaw pusher 116. In one example, the retaining member 206 is a resilient retaining member. The retaining member is aligned with pockets in a jaw recess. In one example, the retaining member is a ball plunger located in first jaw pusher 116. The ball plunger is a resilient member that includes an end 210 that extends through in opening sidewall 204 for interaction with a recess pocket. In this example, the end 210 is the only portion of 206 that sticks out beyond surface 204 thus the non resilient body of 206 is well protected from being damaged during jaw installation and removal.

Figure 8:
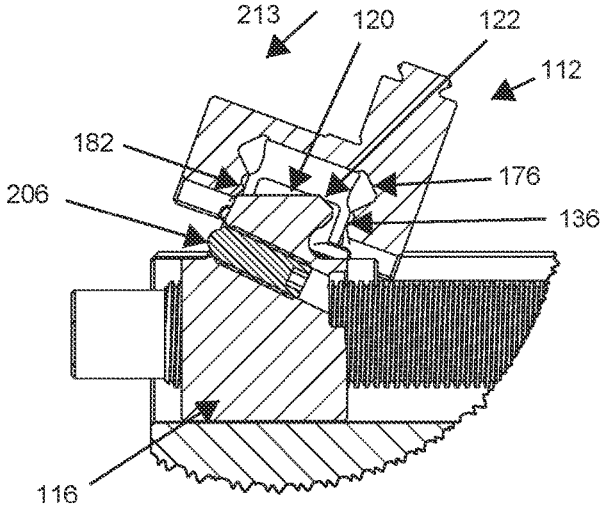
Figure 9:
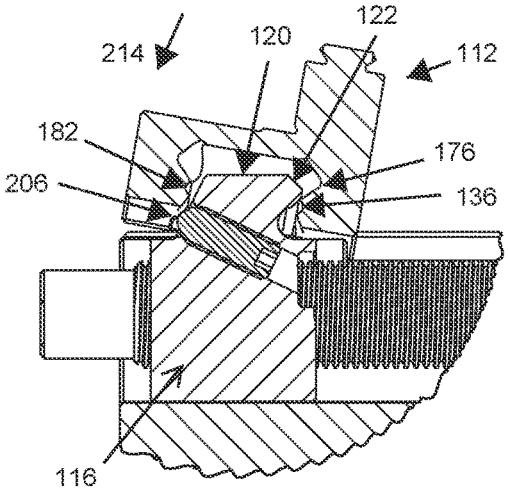
Figure 10:
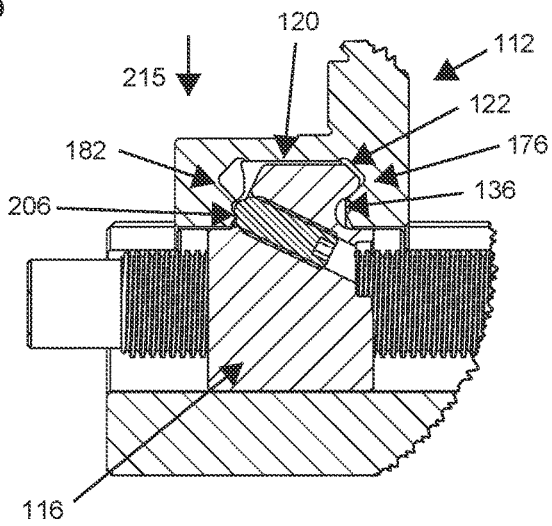

FIGS. 8-10 are cross-sectional views illustrating one example of positioning a jaw on a jaw pusher. This example is described with respect to positioning first jaw 112 on first jaw pusher 116. FIG. 8 illustrates first jaw 112 being initially positioned on first jaw pusher 116. First jaw insert 120 is positioned into first jaw recess 136 (arrow 213).

As illustrated in FIG. 9, the first jaw 112 is simply rotated onto the first jaw pusher 116, indicated by arrow 214. As the first jaw 112 continues to rotate, the first top edge 122 radius edge begins to engage with first angled surface 176. Additionally, the retaining member 206 begins to resiliently move along the interior contour of jaw recess 136. As illustrated in FIG. 9, the first jaw 112 is rotated down until it is positioned on first jaw pusher 116. The first top edge is engaged with first angled surface 176. As illustrated in FIG. 10, the retaining member 206 is moved, snapped or popped into place within pocket 182 in the same motion that puts the jaw in its final position onto the jaw pusher. Final position results in the jaw surfaces 164 being down against the vise body top surfaces. The first jaw 112 is now securely in position on first jaw pusher 116.

Ramps 182 and 176 on the jaws are strategically angled to produce an effective amount of downward force against the vise body along with horizontal force to greatly reduce or eliminate jaw lift created when piece parts are clamped high on the jaw. Clamping a piece part high on the jaw can produce excessive reactive forces high on the jaws at the same time the jaw pushers are producing inward forces low on the jaws. This is countered with the use of the radiused bottom edge of the first top edge 122 pushing horizontally against the ramp which then produces reactive forces downward into the vise body and horizontally to hold piece parts. The bottom radiused edge has an adjacent surface that is angled enough such that the portion of the ramp of the jaw below the radiused edge is never touched. This prevents a cross-over in surfaces which would, in effect, produce jaw lift instead of jaw pull down. Past known devices simply have a ramp on the jaw pusher contacting an internal ramp on the jaw where cross-over of force direction can occur during clamping due to high forces bending the jaw pushers or jaws.

In one example, a pusher radiused edge has a surface angle different (and mismatched) than the angled surface of the ramp that it contacts when the jaw is positioned on the pusher. The geometry of the connection of the jaw and the pusher are intentionally of mismatched angles to allow for deflection of the jaw and pusher under load while maintaining contact at a consistent point of the radiused edge (e.g., a bull nose) of the pusher (e.g., see FIG. 6, FIG. 7 and FIG. 10). This advantageously aids in maintaining a correct distribution of clamping and downward forces between the jaw pusher and the jaw.

Figure 10A:
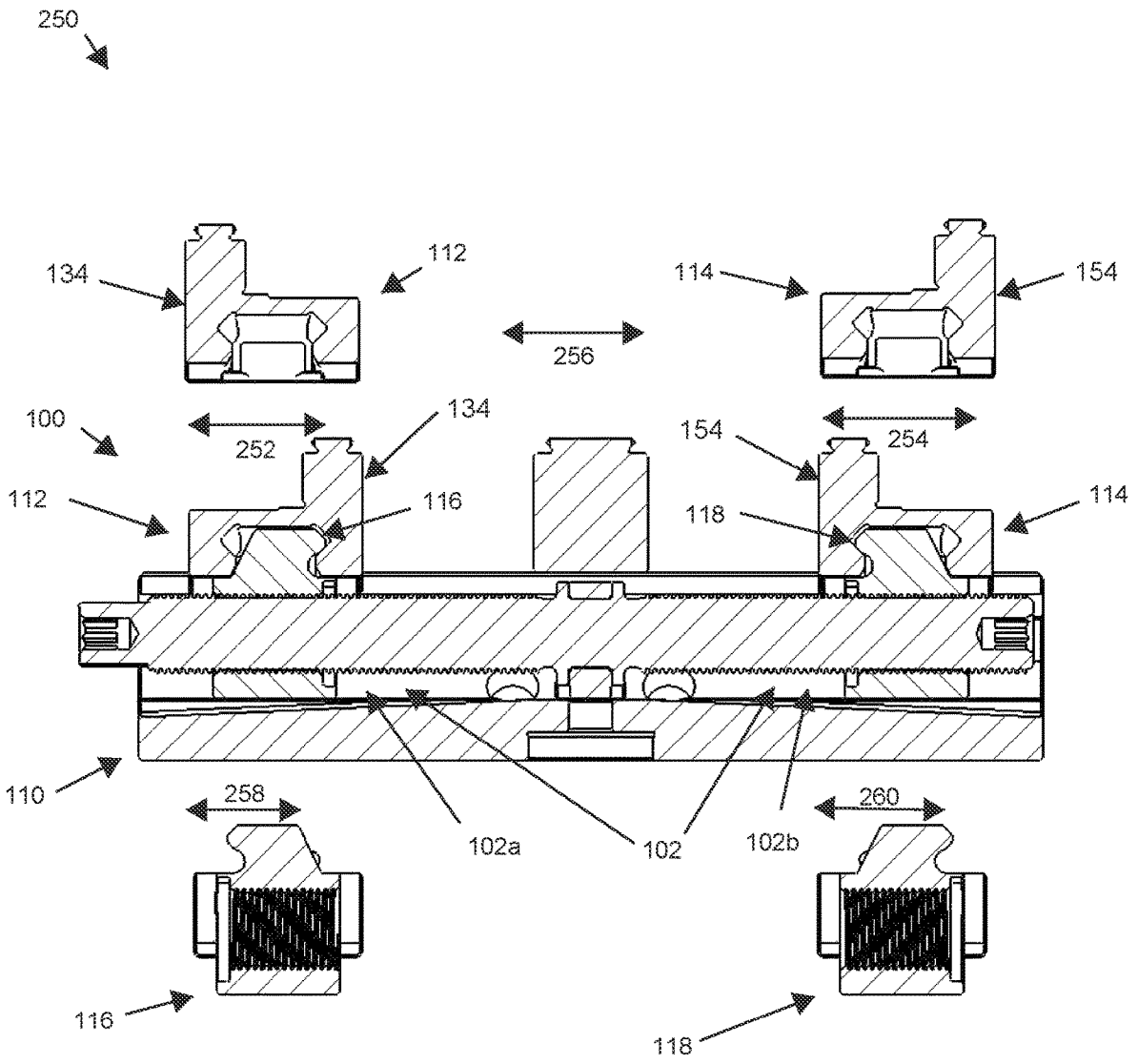
FIG. 10*a* is a cross-sectional view illustrating reversible jaws and jaw pushers.

FIG. 10*a* is a cross-sectional view illustrating reversible jaws and jaw pushers at 250. Due to the unique design of the interaction between the vise jaws and jaw pushers as previously described herein, the vise jaws are reversible on their respective jaw pusher, and also interchangeable with other jaw pushers.

In one example illustrated, first jaw 112 is positioned on first jaw pusher 116 with primary holding surface 134 facing inward towards a center of the vise body 110. First jaw 112 is reversible, and can also be positioned on the first jaw pusher 116 with the primary holding surface 134 facing outward away from the center of the vise body 110 as represented by arrow 252. Similarly, second jaw 114 is positioned on second jaw pusher 118 with primary holding surface 154 facing inward towards a center of the vise body 110. Second jaw 114 is reversible, and can also be positioned on the second jaw pusher 118 with the primary holding surface 154 facing outward away from the center of the vise body 110 as represented by arrow 254.

Additionally, the jaws are reversible and interchangeable with other jaw pushers. As such, first jaw 112 can be positioned on second jaw pusher 118, and is reversible on second jaw pusher 118. Second jaw 114 can be positioned on first jaw pusher 116 and is reversible on first jaw pusher 116. This is represented by arrow 256.

Jaw pushers are reversible on their respective side of the vise assembly 100, but cannot be positioned on the other side of the vise assembly due to the required matching of right hand and left hand threads on the lead screw. In other words, the jaw pushers themselves can be reversed for inward or outward clamping but only on the same ends that match the right or left hand threads. The left hand threaded jaw pusher cannot be put onto the right hand threads of the lead screw.

In one example further illustrated in FIG. 10*a*, lead screw 102 includes a left side 102*a* having left hand threads matched to first jaw pusher 116, and a right side 102*b* having right hand threads matched to second jaw pusher 118. First jaw pusher 116 is reversible on the left side 102*a* of lead screw 102 having left hand threads. This is represented by arrow 258. First jaw pusher 116 cannot be positioned on right side 102*b* having right hand threads since its threads do not match. Second jaw pusher 118 is reversible on the right side 102*b* of lead screw 102 having right hand threads. This is represented by arrow 260. Second jaw pusher 118 cannot be positioned on the left side 102*a* having left hand threads since its threads do not match.

FIG. 11 is a perspective view illustrating one example of a lead screw with a center support shown generally at 270. In one example, the lead screw and center support are a matched set assembly suitable for use with vise 100.

In one example, lead screw 102 is illustrated with center support 104 positioned on the lead screw 102. The lead screw 102 and center support 104 are a matched set assembly. The lead screw 102 and center support 104 are precision ground to fit together, to offer very minimal axial lead screw movement. In one example, the lead screw 102 and center support 104 are precision ground and assembled as a matched set at the factory.

FIG. 12 is a perspective view illustrating one example of a lead screw. In one example. Lead screw 102 includes right hand threads 102*a* and left hand threads 102*b*. The threads 102*a,b* are precision cut. In example, the threads 102*a,b* have a precision cut trapezoidal thread geometry that provides fine actuation accuracy and high force transmission to the vise jaws.

The lead screw 102 includes a center portion 280 including a first center flange 282, a second center flange 284, and a center shaft surface 286. The first center flange 282 is positioned adjacent to right hand threads 102*a*. The second center flange 284 is positioned adjacent to left hand threads 102*b*. The center shaft surface 286 extends between the first center flange 282 and the second center flange 284.

The center shaft surface 286 can be a precision turned and polished surface to offer precision locating and turning of the lead screw within the center support. In one example, the center shaft surface is lubricated. In another example, the center shaft surface can be a loose sloppy fit with the center support top and bottom inside radius. Some vertical slop allows vertical movement of the center shaft to adjust for any jaw pusher mis-alignment that can occur with the jaw pushers also needing to fit into the channel of the vise. Additionally vertical movement of the lead screw/center shaft will accommodate any warpage or lack of straightness in the lead screw. Thus, floating the center shaft/lead screw vertically reduces any binding that could occur during rotation.

The center support 104 can fit precisely on the center shaft surface 286 or can loosely fit on the center shaft surface to accommodate irregularities in the center shaft or jaw pusher positions. In one example, the center support 104 has a thickness or width that is ground to fit (e.g., precisely fit) inside of the first center flange 282 and the second center flange 284, with just enough of a gap to allow rotation of the lead screw 102 relative to the center support 104.

In one example, the lead screw 102 is made of a high alloy steel (e.g., H13), and is heat treated. The lead screw 102 includes a highly lubricious and extremely durable coating. In one example, the coating is a TiCN coating.

FIG. 13 is a side view illustrating one example of center support 104 having a two part assembly. FIG. 14 includes perspective views illustrating the two part assembly of the center support 104 of FIG. 13. As previously described, the center support is precisely manufactured, including precision ground-to-fit sides for positioning on lead screw 102 to create a matched assembly. Further, center support 104 has a two part assembly including top part 290 and base part 292. In one example, the top part 290 is secured to the base part 292 using screws via threaded holes 294. The base part 292 is secured to the vise assembly 100 slotted at base flanges 296*a,b*.

The center support 104 top part 290 precisely fits on the base part 292. In one example, an interface between the top part 290 and base part 292 is a matched cut. The matched cut is created by cutting a single part into two pieces. This results in a first contour 298*a* on the top part 290 that is matched to a second contour 298*b* on the base part 292. In one example, the matched contour 298*a,b* is a non-symmetrical contour that allows for only one-way installation when positioning the center support 104 on the lead screw 102.

Having the top part 290 locked together with the base part 292 via the matched contour 298*a,b* with a non-symmetrical contour prevents one piece from sliding slightly off of the other piece. Keeping the top part 290 and the base part 292 precisely attached in the thickness direction prevents an edge of one of the pieces from digging into a flange 282 or flange 284 of the lead screw 102. This could cause the lead screw 102 to no longer be able to rotate, or cause the lead screw 102 to spin with some drag.

In reference to FIG. 14, the center support 104 two piece assembly allows the center support 104 to be secured about the lead screw 102 and be secured to the vise body 110. Additionally, a radius of the center support 104 inner surface 299 is sized to operably loosely match the diameter of the lead screw 102 center shaft 286. In one example, allowing some movement is preferable in case the lead screw is warped.

Figure 15:
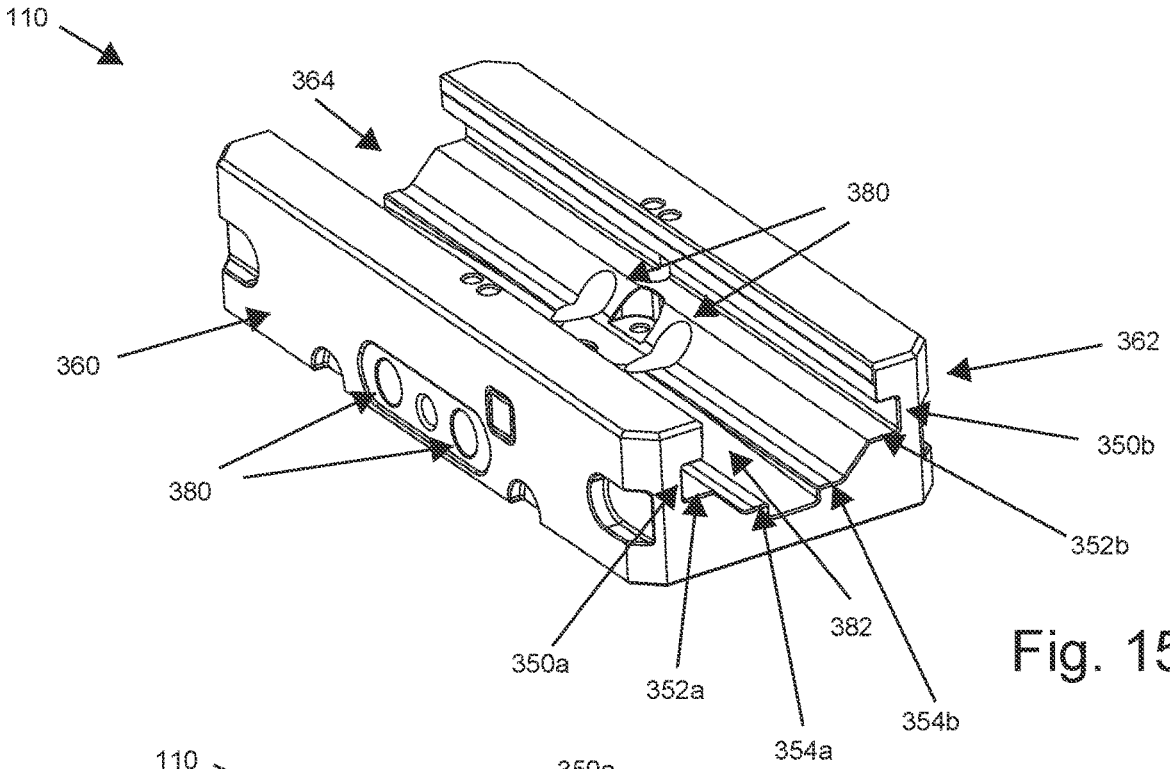
Figure 16:
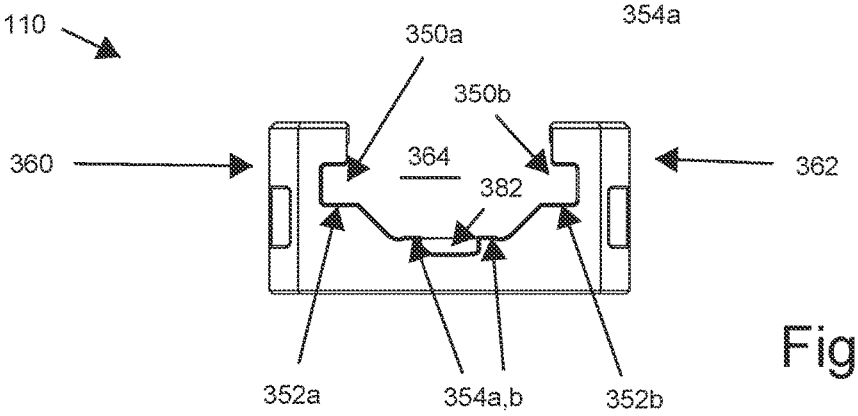
Figure 17:
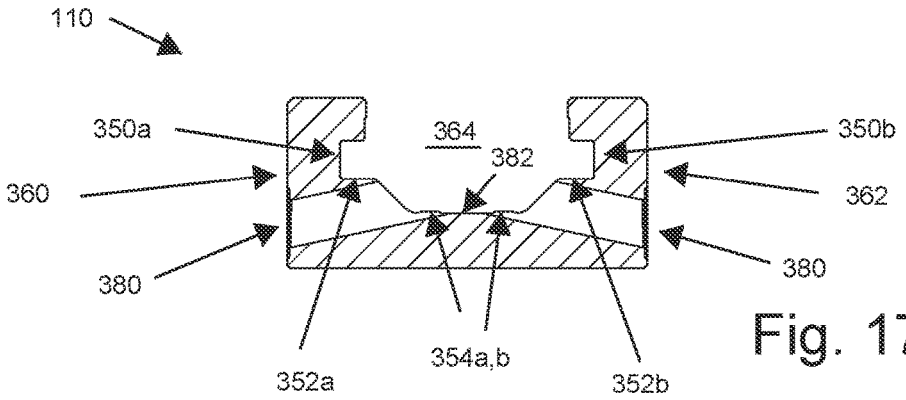

FIG. 15 is a top perspective view illustrating one example of vise body 110. FIG. 16 is an end view the vise body 110 of FIG. 15. FIG. 17 is a side cross-sectional view of the vise body 110 of FIG. 15. The vise body 110 includes a number of surfaces, channels and slots to aid in supporting and moving a jaw pusher. In one example, the vise body 110 includes a pusher side channel 350*a* and pusher side channel 350*b*, and guide surfaces 352*a,b* and 354*a,b*. Vise body 110 includes a first side 360 and a second side 362. A recess 364 extends longitudinally in the vise body 110 for moving a pusher along a lead screw within the vise body 110. A pusher side channel 350*a* is located in first side 360 and a pusher side channel 350*b* is located in second side 362. In operation, the pusher side channel 350*a* and pusher side channel 350*b* receive side edges of a pusher contained in the vise body, to aid in moving the pusher along a lead screw contained within the vise body.

The vise body 110 includes redundant guiding surfaces on each side of the vise body 110 to aid in guiding a pusher located in the vise body. In one example, the vise body includes pusher guide surfaces 352*a,b* and pusher guide surfaces 354*a,b*. The pusher guide surfaces 352*a* and 354*a* are located on first side 360 and the pusher guide surfaces 352*b* and 354*b* are located on second side 362.

Figure 18:
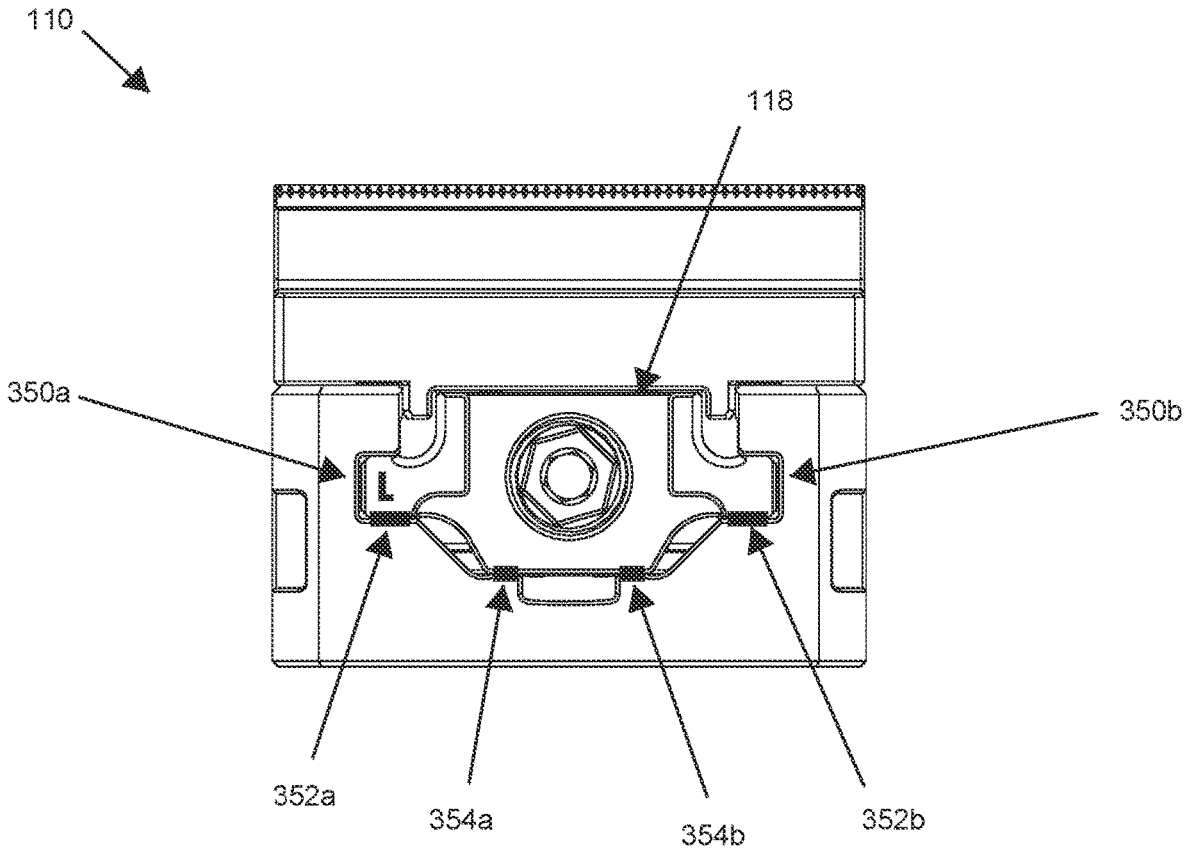

FIG. 18 is an end view illustrating one example of a pusher (e.g., jaw pusher 118) positioned within vise body 110, including having side edges positioned within pusher side channel 350*a* and pusher side channel 350*b*. FIG. 18 further illustrates the interaction between a pusher and the redundant pusher guide surfaces 352*a,b* and 354*a,b* located on vise body 110. Redundant guide surfaces 352*a,b* and 354*a,b* provide additional jaw pusher contact surfaces to reduce wear and stress on the jaw pusher and vise body.

Referring again to FIGS. 15-17, the vise body 110 includes a number of swarf exit holes and swarf flow surfaces. In one example, vise body 110 includes channels 380 with exit holes to allow for swarf and fluid to freely exit the base body. Additionally, the interior bottom surface 382 located under the lead screw is sloped away from a center of the vise body 110 to aid in the evacuation of swarf and liquid flow. In one example, the slope is approximately 3 degrees. This example integrates allowing liquid flow away from the vise center while also having precision surfaces 354*a,b* there to provide pusher support.

Figure 19:
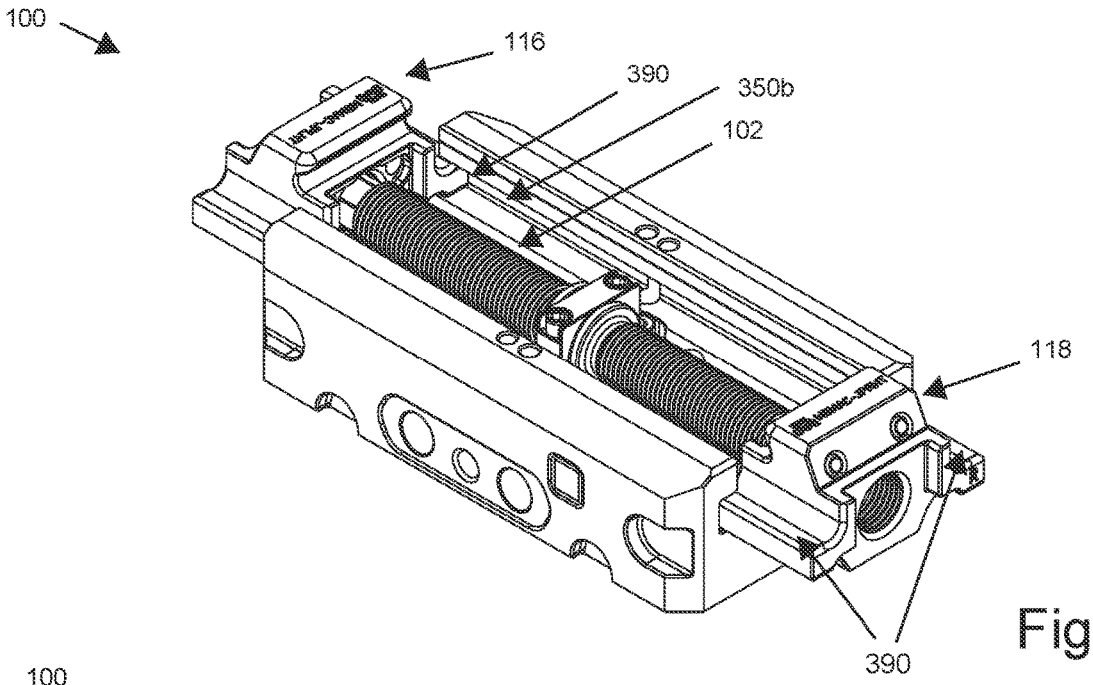
Figure 20:
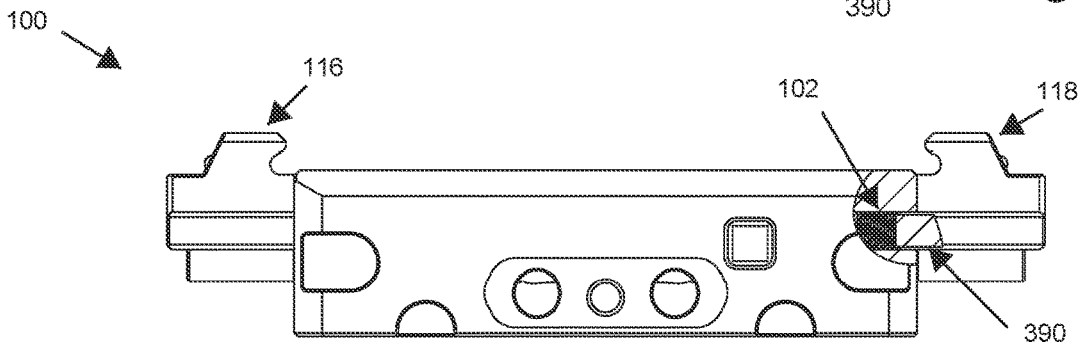
Figure 21:
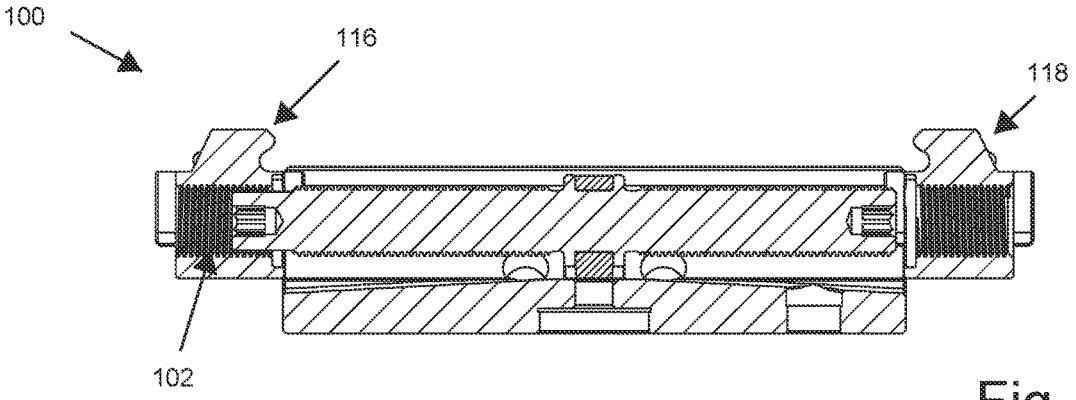

FIGS. 19-21 illustrate one example of the starting of pushers on a vise assembly. FIG. 19 is a top perspective view of vise assembly 100. FIG. 20 is a side view of vise assembly 100. FIG. 21 is a cross section view of vise 100. Jaw pushers 116 and 118 include side wings 390 that insert and ride in the side channels 350*a,b*. See also FIG. 18. The side wings 390 extend out beyond the jaw pusher internal threads on both sides of jaw pusher 112 and jaw pusher 114. These longer wings 390 on the jaw pushers 116, 118 allow for engagement with the vise assembly 100 channels 350*a,b* before the internal threads engage with the lead screw. This allows for easier assembly since it results in the lead screw 102 engaging the threads of pushers 116, 118 at the same time. Since the pushers 116,118 are already positioned within the channels 350*a,b*, they are squared up with the threads of the lead screw 102 for easy thread starting.

Additionally, the lead screw 102 and first jaw pusher 116 and second jaw pusher 118 have timed threads. The 0 degree location of the threads of the lead screw 102 is timed with the 0 degree location of the internal threads on the first jaw pusher 116 and the second jaw pusher 118. Since both the lead screw and jaw pushers are timed, there is no need for serialization. The jaw pushers are inserted into their corresponding channels first, and then simultaneously threaded on to the lead screw. In one example, 0 degrees on the pusher is at a top of the internal threads, and 0 degrees on the lead screw is at a top of the external threads. Additionally, the lead screw left hand threads and right hand threads are timed together.

Figure 22:
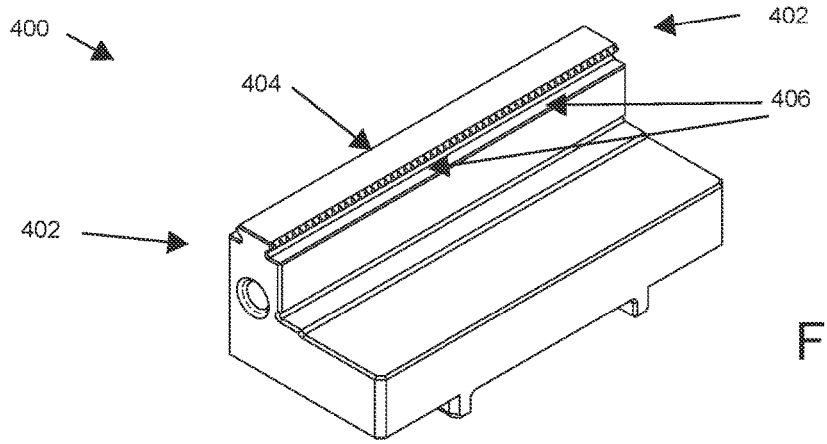
Figure 23:
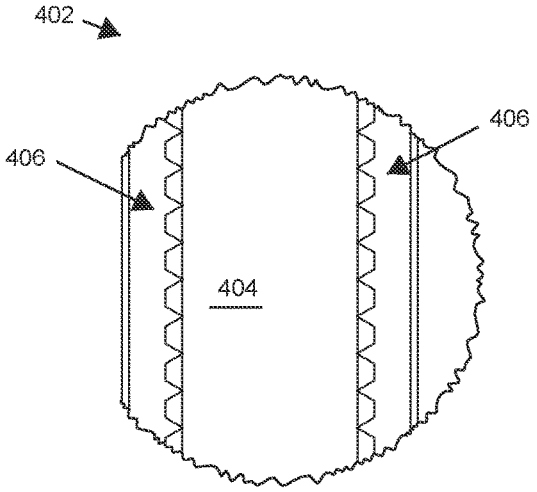
Figure 25:
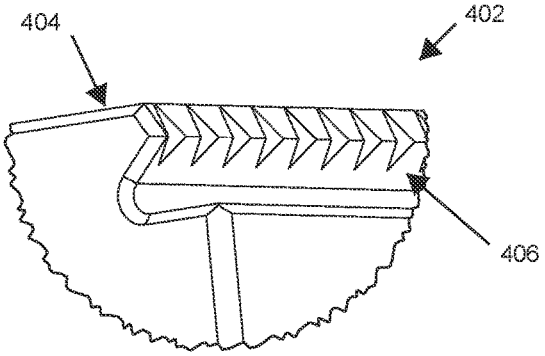

FIGS. 22-26 illustrate one example of jaw teeth. FIG. 22 is a top perspective view of a jaw at 400, which can be similar to the vise jaws previously detailed herein. In one example, jaw 400 includes a jaw top portion 402. The jaw top portion 402 extends longitudinally along the jaw and includes a jaw top 404 that is generally flat. FIG. 23 is a partial top view of the jaw top portion 402, illustrating the generally flat jaw top 404, including jaw teeth 406 extending outward from the jaw top 404.

Figure 24:
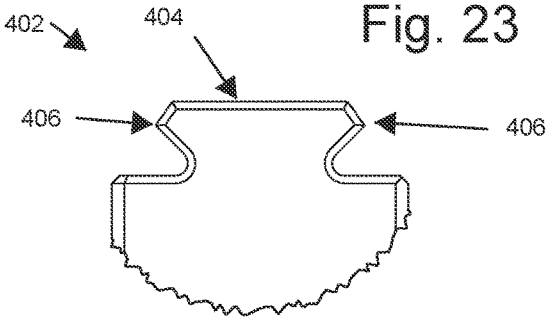
Figure 26:
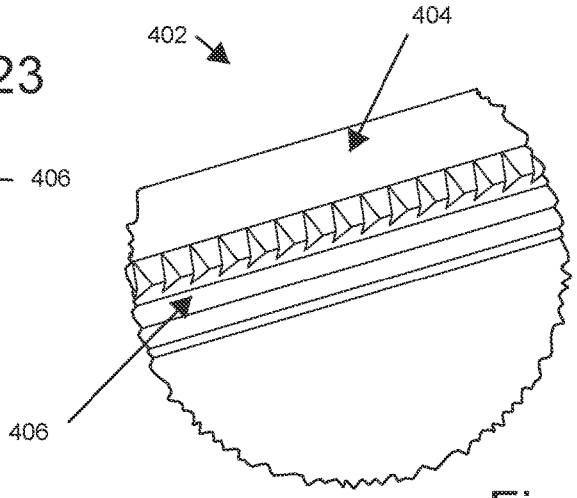

FIG. 24 is a partial side view of the jaw top portion 402. In one example, the jaw top portion 402 has a dovetail configuration or shape. The teeth 406 extending from the jaw top portion 402 including the dovetail piece is further illustrated in partial view in FIG. 25 and FIG. 26.

In one example, the teeth 406 are shaped to provide maximum penetration into a piece part. In one example, the teeth are serrated. In another example, the shape of the teeth is a five sided prismatic shape that comes to a sharp on the side of the jaw, such that the teeth 406 first penetrate the material during clamping. The angle on the top side of the teeth is advantageously angled as compared to the lower angle under the vertical point of the teeth to promote downward piece-part movement as the teeth dig into the material during the clamping operation. Additionally, the advantageous geometry of the teeth in combination with a dovetail angle below the teeth allows the same jaw to be used for dovetail piece holding as well as using the teeth to grip the part.

Figure 27:
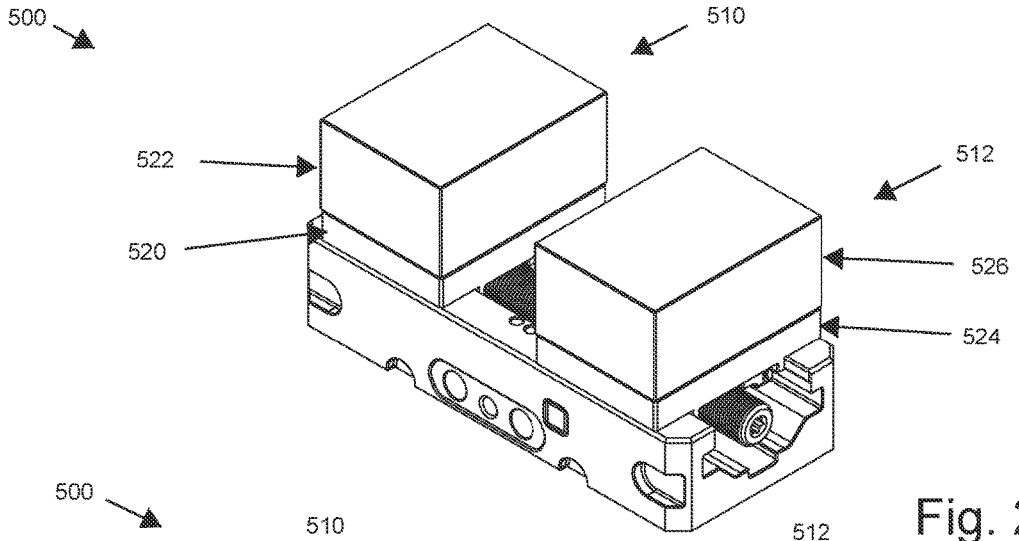

FIGS. 27-30 illustrate one example of a vise assembly with a custom machinable jaw. FIG. 27 is a top perspective view of a vise assembly 500 having a custom machinable jaw, illustrated as first jaw assembly 510 and second jaw assembly 512. The vise assembly 500 is similar to vise assembly 100 previously detailed herein. The custom machinable jaw allows for a lower cost jaw assembly that can be easily machined to fit the shape of a piece part being machined.

Figure 28:
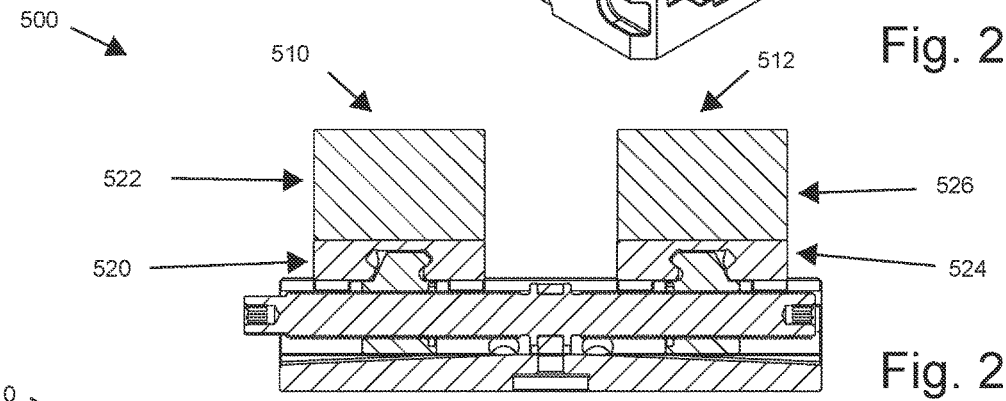

First jaw assembly 510 includes an adapter plate 520 and a top 522. Second jaw assembly 512 includes an adapter plate 524 and a top 526. Referring also to FIG. 28, the adapter plate 520 and the adapter plate 524 include an internal recess similar to jaws previously detailed herein, and as such are configured to receive a jaw insert from a jaw pusher. Similarly, the adapter plates 520,524 are made of a hardened material similar to that of the one piece jaws detailed herein. As such, similar to jaws 112,114 the adapter plates 520,524 provide for the jaws assemblies 510,512 to be reversible and interchangeable, and able to be positioned on a corresponding jaw pusher without the use of tools.

In one example, the top 522 and the top 526 are machinable tops. The top 522 and the top 526 can be made of a lower cost block of material (relative to adapter plates 520, 524) that is easily machinable. As such, the top 526 and top 522 can be customized and easily machined to fit the shape of a piece part being machined.

Figure 29:
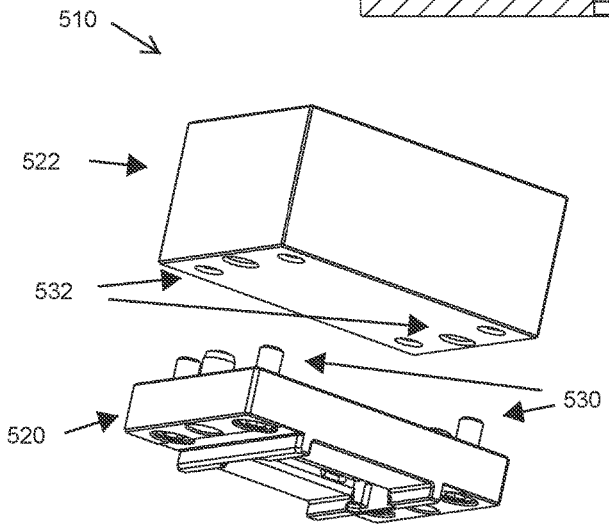
Figure 30:
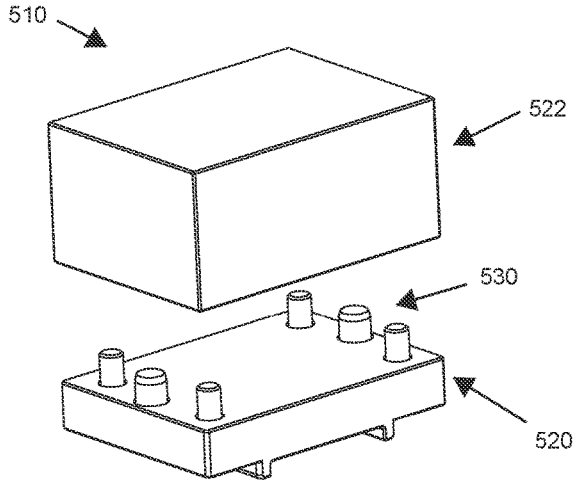

Referring also to FIG. 29 and FIG. 30, in one example the adapter plates (e.g., adapter plate 520) are attached to the machinable tops using bolts and/or dowel pins. In one example illustrated, the adapter plates include dowels and bolts 530 that cooperate with bolt holes and openings 532 in the machinable top. The bolts and dowels sizes and locations can be varied in a non-symmetrical way to create a poka-yoke installation so that the jaw tops can only go on to the adapter plates one way to offer a more precise return of position to the jaws compared to when they were first made. Adding the custom shape to the jaw tops after they are assembled and fastened onto the adapter plates makes this possible.

Figure 31:
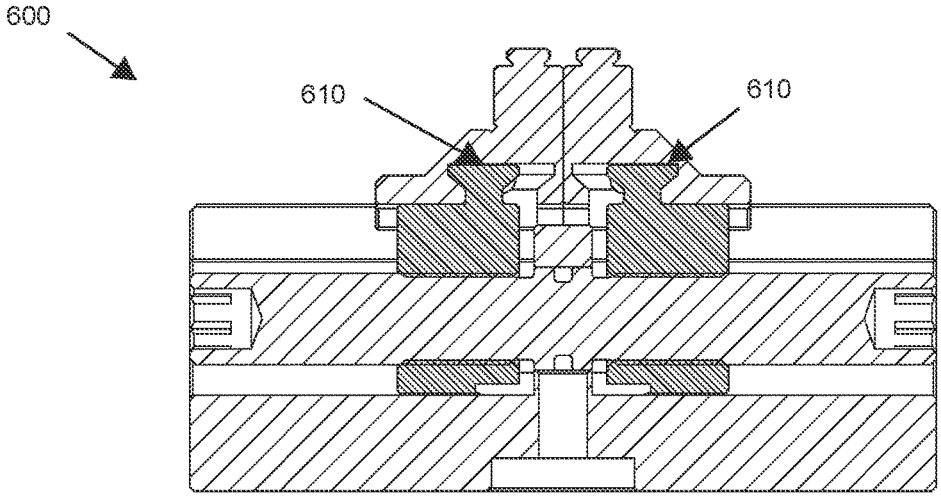

FIG. 31 illustrates one example of a vise assembly 600 having a dual pusher 610. The vise assembly 600 is similar to the vise assemblies previously described here. The dual pusher 610 is configured for both inward or outward pushing. As such, one advantage of dual pusher 610 is that it does not have to be dis-assembled off of the leadscrew, turned around, and then reassembled if outward clamping is desired instead of inward clamping.

Figure 32:
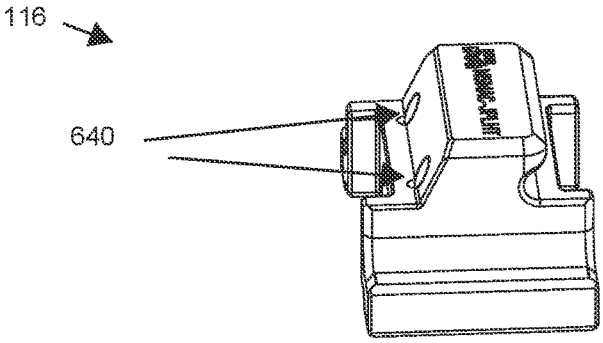
Figure 33:
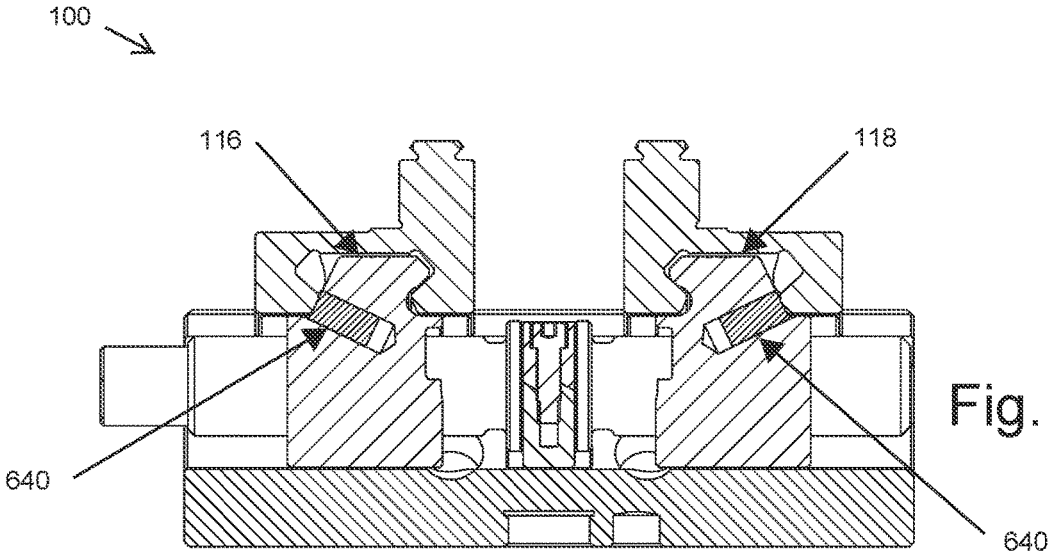

FIG. 32 illustrates one example of a jaw pusher (e.g., jaw pusher 116) for use with a vise assembly detailed herein. In this example, the jaw pusher 116 includes one or more magnets 640. FIG. 33 is a cross-section view illustrating one example of a vise assembly including a jaw pusher having one or more magnets as illustrated in FIG. 32. When a jaw is positioned on to jaw pusher 116, the magnets operate to resiliently or releasably retain the jaw on the jaw pusher 116. As such, the jaw can be positioned on the jaw pusher 116 and removed from the jaw pusher 116 without the use of tools.

FIG. 34 is a perspective view illustrating a vise assembly 100 with a hardened jaw and a custom machinable jaw attached. Vise assembly 100 includes a jaw assemblies 700*a* and jaw assembly 700*b*. The jaw assemblies 700*a*, 700*b* are two part jaw assemblies. The first jaw part 710 is configured to operate with a jaw pusher as previously described herein. The second jaw part 720 is a machinable jaw block mounted with bolts to the standard jaw. The machinable jaw block can be made of a lower cost block of material (relative to first jaw part 710) that is easily machinable. As such, the second jaw part can be customized and easily machined to fit the shape of a piece part being machined. Adapting standard jaws to receive customizable jaws offers cost savings by not needing a jaw adapter whilst still having a customized low cost machinable jaw.

Figure 35:
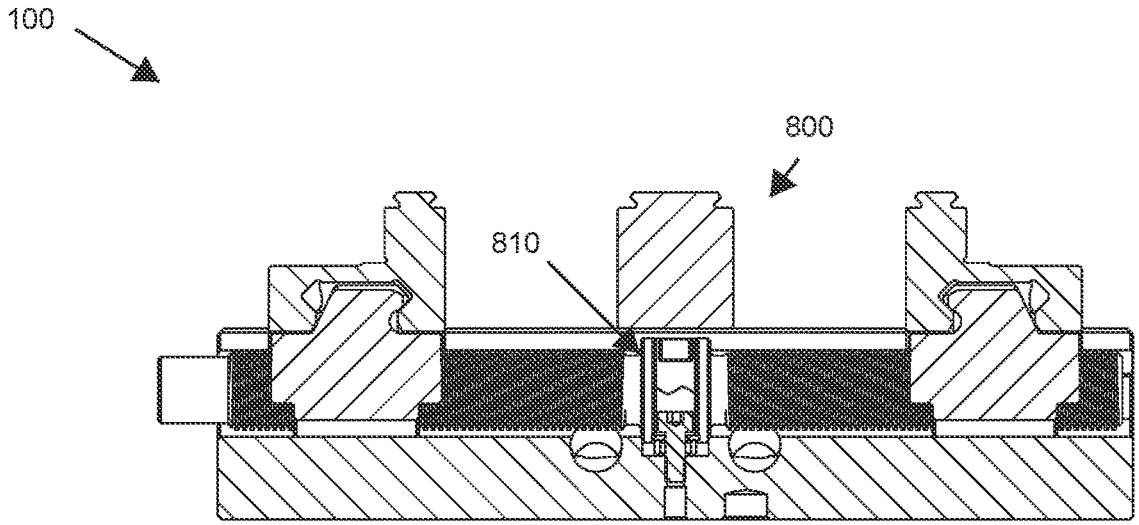
Figure 36:
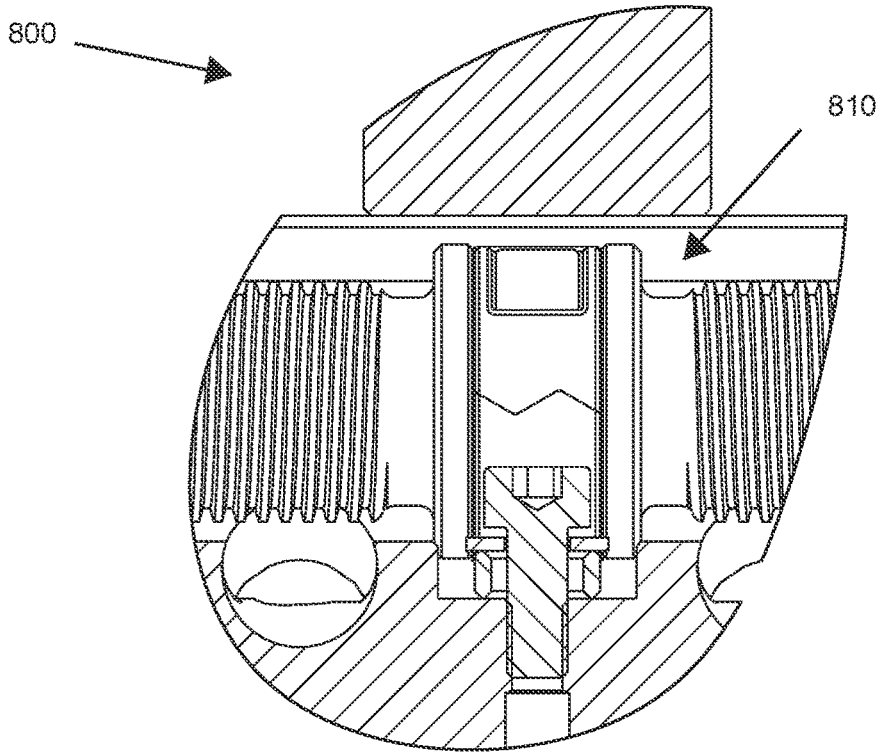

FIG. 35 is one example of a vise assembly 100 having a center jaw 800 with a float feature. FIG. 36 is a partial close-up view of the center jaw 800 of FIG. 35. As previously detailed herein, the center jaw 800 is used when piece parts are placed on both sides of the center jaw 800 to allow machining of more parts with a single vise assembly.

The center jaw 800 also operates to center the jaws on the vise. The center jaw 800 includes adjustment devices 810 for making adjustments to the vise assembly such as to accommodate different piece parts. In one example, adjustment devices 810 include lower screws that can be loosened a ¼ turn or even removed completely to allow a small amount of variation in piece parts size between the two sides of the center jaw 800. Additionally, there are slots (e.g., see FIG. 14 slotted base flanges 296*a,b*) in the lower part of the center support under the lower screws that allow the needed axial movement of the lead screw assembly which allows the moveable jaws and jaw pushers to move as needed to accommodate size difference in piece parts. The lower slots also double for allowing adjustment in centering the vise jaws/pusher/lead screw when there is no center jaw attached.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A vise assembly comprising:

a vise body;

a jaw pusher movably coupled to the vise body, the jaw pusher including a jaw insert having a first top edge, a second top edge, and a top between the edges where the first top edge is an outward extending radius edge including an angled surface and a radiused bottom side along the outward extending radius edge; and a jaw having a jaw top and a jaw bottom, the jaw bottom including a recess for receiving the jaw insert, the recess including a ramped surface extending longitudinally along a top edge for receiving the outward extending radius edge and wherein the jaw is positioned on the jaw pusher without the use of tools, and wherein the outward extending radius edge is mismatched with the ramped surface.

2. The vise assembly of claim 1, where the jaw insert is positioned in the jaw recess as the jaw is rotated onto the jaw pusher having jaw insert surfaces effectively contoured along with an effectively contoured jaw receiving pocket to allow snap-on/snap off installation and removal.

3. The vise assembly of claim 1, where the jaw includes an inward facing position and an outward facing position, and where the jaw can be positioned on the jaw pusher in the inward facing position or the outward facing position.

4. The vise assembly of claim 1, comprising a lead screw assembly, where the jaw pusher is movably coupled to the vise body by the lead screw assembly through a center support.

5. The vise assembly of claim 1, the jaw pusher further including a retaining mechanism for removably retaining the jaw on the jaw pusher.

6. The vise assembly of claim 5, where the retaining mechanism is a ball plunger.

7. The vise assembly of claim 1, the recess including a second ramped surface extending longitudinally along a second top edge for receiving the outward extending radius edge.

8. The vise assembly of claim 1, where the recess includes a surface pocket located adjacent the ramped surface, the surface pocket receives and holds the retaining mechanism when the jaw is positioned on the jaw pusher.

9. The vise assembly of claim 1, where only the radiused bottom side engages with the ramped surface when positioning the jaw insert in the recess.

10. The vise assembly of claim 1, where the second top edge is a start of a slanted sidewall that transitions from the second top edge to a jaw pusher body.

11. A vise assembly comprising:

a vise body;

a jaw pusher movably coupled to the vise body, the jaw pusher including a jaw insert having a first top edge and a second top edge, where the first top edge is an outward extending radius edge;

a jaw having a jaw top and a jaw bottom, the jaw bottom including a recess for receiving the jaw insert, the recess including a ramped surface extending longitudinally along a top edge for receiving the outward extending radius edge and wherein the jaw is positioned on the jaw pusher without the use of tools, wherein the outward extending radius edge is mismatched with the ramped surface;

the jaw pusher further including a retaining mechanism for removably retaining the jaw on the jaw pusher; and the recess including a surface pocket located below the ramped surface that receives the retaining mechanism when the jaw is positioned on the jaw pusher.

12. A vise assembly comprising:

a vise body;

a lead screw coupled to the vise body via a center support;

a pair of opposing jaw pushers movably coupled to the lead screw, including a first jaw pusher and a second jaw pusher;

a first jaw positioned on the first jaw pusher and a second jaw positioned on the second jaw pusher, where the first jaw is positionable on the first jaw pusher without the use of tools, and the second jaw is positionable on the second jaw pusher without the use of tools; and where the first jaw is reversible on the first jaw pusher, and the second jaw is reversible on the second jaw pusher, and the first jaw pusher and the second jaw pusher each including a jaw insert having a first top edge, a second top edge and a top between the edges, where the first top edge is an outward extending radius edge having an angled surface and a radiused bottom side along the outward extending radius edge; and the first jaw and the second jaw each having a jaw top and a jaw bottom, the jaw bottom including a recess configured to receive the jaw insert, the recess including a ramped surface extending longitudinally along a top edge for rotatably receiving the outward extending radius edge, where only the radiused bottom side is in contact with the ramped surface when the jaw insert is positioned in the recess.

13. The vise assembly of claim 12, where the outward extending radius edge is configured as a bull nose design extending outward along the top edge.

14. The vise assembly of claim 12, comprising a center jaw coupled to the vise body and positioned over the center support.

15. The vise assembly of claim 12, where a center support thickness is precision ground fit with a lead screw flanges width to provide minimal lead screw axial movement for vise jaw centering precision repeatability.

16. The vise assembly of claim 12, the first jaw and the second jaw having a longitudinally extending top edge that contacts a work piece held in the vise, the longitudinally extending top edge comprising serrated teeth.

17. The vise assembly of claim 12, the first jaw having a hold high configuration having a top with a dovetail geometry, including at least one top edge having teeth, where the teeth have a five sided prismatic geometry shape.

18. A vise assembly comprising:

a vise body;

a lead screw coupled to the vise body via a center support;

a pair of opposing jaw pushers movably coupled to the lead screw, including a first jaw pusher and a second jaw pusher;

a first jaw positioned on the first jaw pusher and a second jaw positioned on the second jaw pusher, where the first jaw is positionable on the first jaw pusher without the use of tools, and the second jaw is positionable on the second jaw pusher without the use of tools; and where the first jaw is reversible on the first jaw pusher, and the second jaw is reversible on the second jaw pusher, and the first jaw pusher and the second jaw pusher each including a jaw insert having a first top edge and a second top edge, where the first top edge is an outward extending radius edge; and the first jaw and the second jaw each having a jaw top and a jaw bottom, the jaw bottom including a recess configured to receive the jaw insert, the recess including a ramped surface extending longitudinally along a top edge for rotatably receiving the outward extending radius edge, where only the outward extending radius edge is in contact with the ramped surface when the jaw insert is positioned in the recess;

the first jaw pusher and the second jaw pusher each including a retaining mechanism for removably retaining the jaw on the jaw pusher; and the recess including a surface pocket located below the ramped surface that receives the retaining mechanism when the first or second jaw is positioned on the corresponding first or second jaw pusher.

19. A vise assembly comprising:

a vise body;

a lead screw coupled to the vise body via a center support;

a pair of opposing jaw pushers movably coupled to the lead screw, including a first jaw pusher and a second jaw pusher;

a first jaw positioned on the first jaw pusher and a second jaw positioned on the second jaw pusher, where the first jaw is positionable on the first jaw pusher without the use of tools, and the second jaw is positionable on the second jaw pusher without the use of tools; and where the first jaw is reversible on the first jaw pusher, and the second jaw is reversible on the second jaw pusher, and the first jaw pusher and the second jaw pusher each including a jaw insert having a first top edge and a second top edge, where the first top edge is an outward extending radius edge;

the first jaw and the second jaw each having a jaw top and a jaw bottom, the jaw bottom including a recess configured to receive the jaw insert, the recess including a ramped surface extending longitudinally along a top edge for rotatably receiving the outward extending radius edge, where only the outward extending radius edge is in contact with the ramped surface when the jaw insert is positioned in the recess; and where the center support comprises a top piece and a bottom piece, where the top piece is contour-matched to the bottom piece and where a matched contour between the top piece and the bottom piece is a matched cut having a non-symmetrical contour.

20. The vise assembly of claim 19, where the bottom piece is coupled to the vise body via at least one tuning bolt, that provides for positional center tuning of the lead screw, jaws and jaw pushers to the vise body.

* * * * *